US006350073B1

(12) United States Patent
McCue, Jr. et al.

(10) Patent No.: US 6,350,073 B1
(45) **Date of Patent: *Feb. 26, 2002**

(54) Z-FOLD PRINT MEDIA HANDLING SYSTEM

(75) Inventors: Thomas E McCue, Jr.; Gary Hays, both of Vancouver; John C Santon, Brush Prairie; Raymond C Sherman, Camas; William Watts, Vancouver; Jeffrey T Hendricks, Camas; Ivan F. Crespo, Vancouver, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/615,689

(22) Filed: Jul. 12, 2000

Related U.S. Application Data

(63) Continuation of application No. 09/318,673, filed on May 25, 1999.

(51) Int. Cl.[7] ..... B41J 11/42

(52) U.S. Cl. ..... 400/582; 400/624; 400/626; 347/104

(58) Field of Search ..... 400/582, 583, 400/584, 605, 607, 624, 625, 626, 56–59; 347/104, 105

(56) References Cited

U.S. PATENT DOCUMENTS

| | | | | |
|---|---|---|---|---|
| 4,923,188 A | | 5/1990 | Neir | 270/39 |
| 5,226,742 A | * | 7/1993 | Pintar et al. | 400/583.4 |
| 5,269,613 A | | 12/1993 | Olson et al. | 400/569 |
| 5,305,020 A | | 4/1994 | Gibbons et al. | 347/177 |
| 5,391,008 A | * | 2/1995 | Hattori | 400/605 |
| 5,772,339 A | | 6/1998 | Yamaguchi | 400/55 |
| 5,819,666 A | | 10/1998 | Ishikawa et al. | 101/483 |
| 5,838,338 A | | 11/1998 | Olson | 347/8 |

FOREIGN PATENT DOCUMENTS

| | | | | |
|---|---|---|---|---|
| JP | 4 31071 A | * | 2/1992 | 400/618 |

* cited by examiner

*Primary Examiner*—John S. Hilten
*Assistant Examiner*—Minh H. Chau
(74) *Attorney, Agent, or Firm*—Flory L. Martin

(57) ABSTRACT

A Z-fold print media handling system for printing banners and the like uses an inkjet printing mechanism without a tractor-feed. A series of stuttering stopping and starting steps generates varying static and dynamic frictional forces to separate the first sheet of a Z-fold stack from the remainder of the stack. Both conventional cut-sheet media and Z-fold media are fed using the same printing mechanism, which pulls the media toward a printzone through frictional engagement with a first surface of the media To prevent printhead crashes and smearing the image near the perforations joining the Z-fold sheets, the printhead to media spacing is increased for Z-fold media over the standard spacing used for cut-sheet media. A cam feature is incorporated into the media drive clutch disk to determine whether an operator has set a selector lever for cut-sheet or Z-fold printhead to media spacing.

22 Claims, 16 Drawing Sheets

Z-FOLD PRINT MEDIA HANDLING SYSTEM

CROSS REFERENCE TO RELATED APPLICATION(S)

This is a continuation of copending application Ser. No. 09/318,673 filed May 25, 1999.

FIELD OF THE INVENTION

The present invention relates generally to printing mechanisms, and more particularly to a system for handling accordion-fold or Z-fold print media, such as for printing banners and the like, using an inkjet printing mechanism without needing a bulky and noisy tractor-feed mechanism.

BACKGROUND OF THE INVENTION

Inkjet printing mechanisms use cartridges, often called "pens," which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezoelectric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To print an image, the printhead is scanned back and forth across a printzone above the sheet, with the pen shooting drops of ink as it moves. By selectively energizing the resistors as the printhead moves across the sheet, the ink is expelled in a pattern on the print media to form a desired image (e.g., picture, chart or text). The nozzles are typically arranged in linear arrays usually located side-by-side on the printhead, parallel to one another, and perpendicular to the scanning direction, with the length of the nozzle arrays defining a print swath or band. That is, if all the nozzles of one array were continually fired as the printhead made one complete traverse through the printzone, a band or swath of ink would appear on the sheet. The width of this band is known as the "swath width" of the pen, the maximum pattern of ink which can be laid down in a single pass. The media is moved through the printzone, typically one swath width at a time, although some print schemes move the media incrementally by for instance, halves or quarters of a swath width for each printhead pass to obtain a shingled drop placement which enhances the appearance of the final image.

The picking and movement of print media through the printzone of an inkjet printing mechanism is the subject addressed herein. The print media, may be any type of substantially flat material, such as plain paper, specialty paper, card-stock, fabric, transparencies, foils, mylar, etc., but the most common type of medium is paper. For convenience, we will discuss printing on paper as a representative example of these various types of print media. The media may be supplied to the printing mechanism in a variety of different configurations. For instance, in desktop inkjet printers, paper is typically supplied in a stack of cut-sheets, such as letter size, legal size, or A-4 size paper, which are placed in an input tray. Typically, sheets are sequentially pulled from the top of the stack and printed on, after which they are deposited in an output tray. Other types of inkjet printing mechanisms feed the paper from a continuous roll, such as an inkjet plotter. Upon completion of plotting an image or drawing on a portion of the continuous roll, the plotter has a severing mechanism to cut the newly printed sheet from the remainder of the roll.

It would be desirable to have an inkjet printing mechanism which can print on both Z-fold media and conventional cut-sheets of media A Z-fold or accordion folded stack of media has each sequential sheet joined to the adjacent sheet along a fold, with the sheets being bent back onto one another into a Z-shape when viewed from the side. Along each side, conventional Z-fold paper has border extensions with a series of evenly-spaced holes therethrough which are engaged by sprockets of a tractor-feed mechanism on the printer to advance the media through the printzone. Typically Z-fold paper came supplied in a letter sized stack, with perforations along the folds at the top and bottom of each sheet to assist in separating the sheets upon completion of the print job. The border extensions with the tractor feed holes are also joined to the side edges of the media at perforations, which enables separation of the borders from the sheet upon completion of the print job. Unfortunately, the tractor-feed mechanisms were very expensive to build, and often noisy in operation. Furthermore, most of these tractor-fed printers were bulky, increasing the overall size or "footprint" of the printer, so excessive desk top space in the work environment was occupied by these earlier printers.

Yet it would be desirable to use Z-fold paper in a conventional cut-sheet inkjet printing mechanism without a costly tractor-feed. Z-fold media is particularly useful for printing banners, extended graphs, continuous scrolls or outlines of text, and a variety of other images, such as artwork and the like. The versatility of an inkjet printing mechanism would be greatly enhanced if it could feed not only cut-sheets of paper but also Z-fold media. Unfortunately, conventional inkjet printing mechanisms are unable to feed a Z-fold stack of paper from a cut-sheet input tray. By tearing the border extensions off of a Z-fold paper stack, the Z-fold paper will fit in the input tray, but conventional inkjet printing mechanisms are unable to pick the Z-fold media from the tray. Because the Z-fold sheets are physically attached to one another, often the conventional printer tries to pick the entire stack all at once, leading to a significant paper jam. This problem is often encountered in cut-sheet media feeding, and is known in the art as a "multiple pick," where several sheets are picked from the input tray all at once.

For cut-sheet media, this multiple pick problem is often remedied by using a friction separator pad at the edge of the input tray, where media begins to enter the feed zone. The media drive rollers feed the sheet through the feed zone. If the second sheet from the top of the stack moves with the first sheet, the second sheet is driven over a friction separator pad. The coefficient of friction of the friction separator pad to the media is higher than the coefficient of friction between the two media sheets. Thus, the second sheet stops on the separator pad and does not continue to be fed through the mechanism. This prevents a multiple pick. Unfortunately, this conventional manner of preventing multiple picks with cut-sheet media does not work with a Z-fold stack of media because the sheets are all attached, and the first sheet pulls in the second sheet, the third sheet, etc.

For cut-sheet media, sheets left on the separator pad are pushed off the separator pad by a kicker. As the first sheet moves through the feed zone, the trailing edge of the first sheet eventually passes across the feed zone entrance. This trailing edge releases or activates the kicker which pushes the second sheet off of the separator pad and back into the input tray. Without a kicker, the number of multiple picks would increase. For instance, if this partially fed second sheet was not kicked back and the operator added more media on top of the existing media in the input tray, then a multiple pick usually occurs near this remaining partially fed sheet and the new media which has been loaded on top of it. Thus, kickers play an important role in preventing multiple picks when using cut-sheet media. Unfortunately, this conventional kicker method of pushing media off the friction separator pad is totally ineffective to prevent Z-fold media multiple picks. Since the kicker is not mechanically activated until the trailing edge of the last sheet passes through the feed zone entrance, any multiple picks of the Z-fold stack have already occurred when the kicker is finally activated. Thus, the kicker has no function in Z-fold media picking.

Other solutions were also tried to feed Z-fold media. An earlier system tested by the inventors used a hinged guide wall that was elevated by a user when feeding Z-fold paper. Unfortunately, this system was extremely cumbersome. This system required removal of the output tray, and an elaborate threading scheme to insert the leading edge of the Z-fold stack into the media pick area. This loading technique was complex and not very "user friendly." It required a good degree of manual dexterity to thread the media, and it was not intuitive or easy to remember. Most users want to see their image printed, and they do not want to be bothered by elaborate and time-consuming media loading schemes.

Thus, a need exists for a versatile, compact and economical inkjet system mechanism, capable of feeding both cut-sheets of media and Z-fold media, which is quiet and easy to use.

SUMMARY OF THE INVENTION

According to one aspect of the invention, a method of printing on a Z-fold media from an input of an inkjet printing mechanism is provided. The printing mechanism has an inkjet printhead that prints on media in a printzone. The Z-fold media includes a first sheet that defines a leading edge and a subsequent second sheet. The second sheet is attached to the first sheet in a Z-fold arrangement, with a first surface of the first sheet in contact with a first surface of the second sheet. The method includes the step of incrementally advancing the leading edge of the Z-fold media from the input toward the printzone in a series of forward steps through frictional engagement with a second surface of the first sheet, which is opposite the first surface of the first sheet. Each of these forward steps of the series is separated in time by a pause. In a separating step, the first surface of the first sheet of Z-fold media is separated from the first surface of the second sheet during said advancing step. After the separating step, in a moving step, the Z-fold media is moved into the printzone to receive ink ejected from the printhead.

According to another aspect of the invention, a method is provided for printing on either cut-sheet media or on Z-fold media when loaded in an input of an inkjet printing mechanism, where the printing mechanism has an inkjet printhead that prints on media in a printzone. The method includes the step of adjusting a printhead to media spacing, defined by a distance between the printhead and media when in the printzone for printing, to a cut-sheet spacing for printing on cut-sheet media or to a Z-fold spacing for printing on Z-fold media. In a monitoring step, the printhead to media spacing is monitored to determine whether the printhead to media spacing is at the cut-sheet spacing or at the Z-fold spacing. In an advancing step, the loaded media is advanced from the input to the printzone to receive ink ejected from the printhead.

According to a further aspect of the invention, a method is provided for printing on this Z-fold media in an inkjet printing mechanism, including the step of advancing the leading edge of the Z-fold media from the input toward the printzone through frictional engagement of a roller member with a second surface of the first sheet which is opposite the first surface of the first sheet. During the advancing step, the first sheet and the second sheet are simultaneously bent around the roller member in a bending step. During the bending step, in a separating step, the first surface of the first sheet is separated from the first surface of the second sheet. After the separating step, the Z-fold media is moved into the printzone to receive ink ejected from the printhead in a moving step. In the illustrated embodiment, a series of other steps are performed before printing to separate the Z-fold sheets of media, and to prevent fold failures, a significant problem encountered during development of the claimed invention.

According to an additional aspect of the invention, a method is provided for inkjet printing on this Z-fold media, where the Z-fold media also has a last sheet defining a trailing edge and having an outer surface. The method includes the step of advancing the leading edge of the Z-fold media from the input toward the printzone through frictional engagement of a roller member with a second surface of the first sheet which is opposite the first surface of the first sheet. During the advancing step, in a gripping step, the outer surface of the last sheet is gripped with a first friction member located at the input. During the gripping step, the first surface of the first sheet is separated from the first surface of the second sheet by pulling the first sheet with the roller member toward the printzone in a separating step. After the separating step, the Z-fold media is moved into the printzone to receive ink ejected from the printhead in a moving step.

According to still another aspect of the invention, an inkjet printing mechanism is provided for printing on either cut-sheet media, or on Z-fold media, which may use the method steps described above. In particular, a media selection monitoring mechanism is provided to monitor which type of media, cut-sheet or Z-fold has been selected by an operator. The printing mechanism has a controller that includes a monitoring portion responsive to the media selection monitoring mechanism to determine whether the printhead to media spacing has been adjusted for cut-sheet media or for Z-fold media.

An overall goal of present invention is to provide a Z-fold media handling system for an inkjet printing mechanism which is also capable of feeding conventional cut-sheets of media.

A further goal of present invention is to provide an inkjet printing mechanism capable of using both Z-fold and cut-sheet media which is easy to use, economical, and provided in a compact inkjet printing mechanism.

Another goal of present invention is to provide a method of picking and feeding Z-fold media using an inkjet printing mechanism that is also capable of printing on cut-sheet media, without inducing fold failures in the Z-fold media.

An additional goal of the present invention is to provide an economical method of operating an inkjet printing mechanism which optimizes the print quality of an image when printed on either Z-fold or cut-sheet media, and which operates quietly, with minimal user intervention.

BRIEF DESCRIPTION OF THE DRAWINGS

FIG. 5 shows the initial loading of a Z-fold stack of media;

FIG. 6 shows a first step;

FIG. 7 shows a second step;

FIG. 8 shows a third step;

FIG. 9 shows both a fourth step and a sixth step;

FIG. 10 shows a fifth step;

FIG. 11 shows a seventh step;

FIG. 12 shows an eighth step; and

FIG. 13 shows a ninth step.

FIG. 17 shows a rest state before the feedback routine begins;

FIG. 18 shows the beginning of the feedback routine; and

FIG. 19 shows the end of the feedback routine.

DETAILED DESCRIPTION OF A PREFERRED EMBODIMENT

Figure 1:
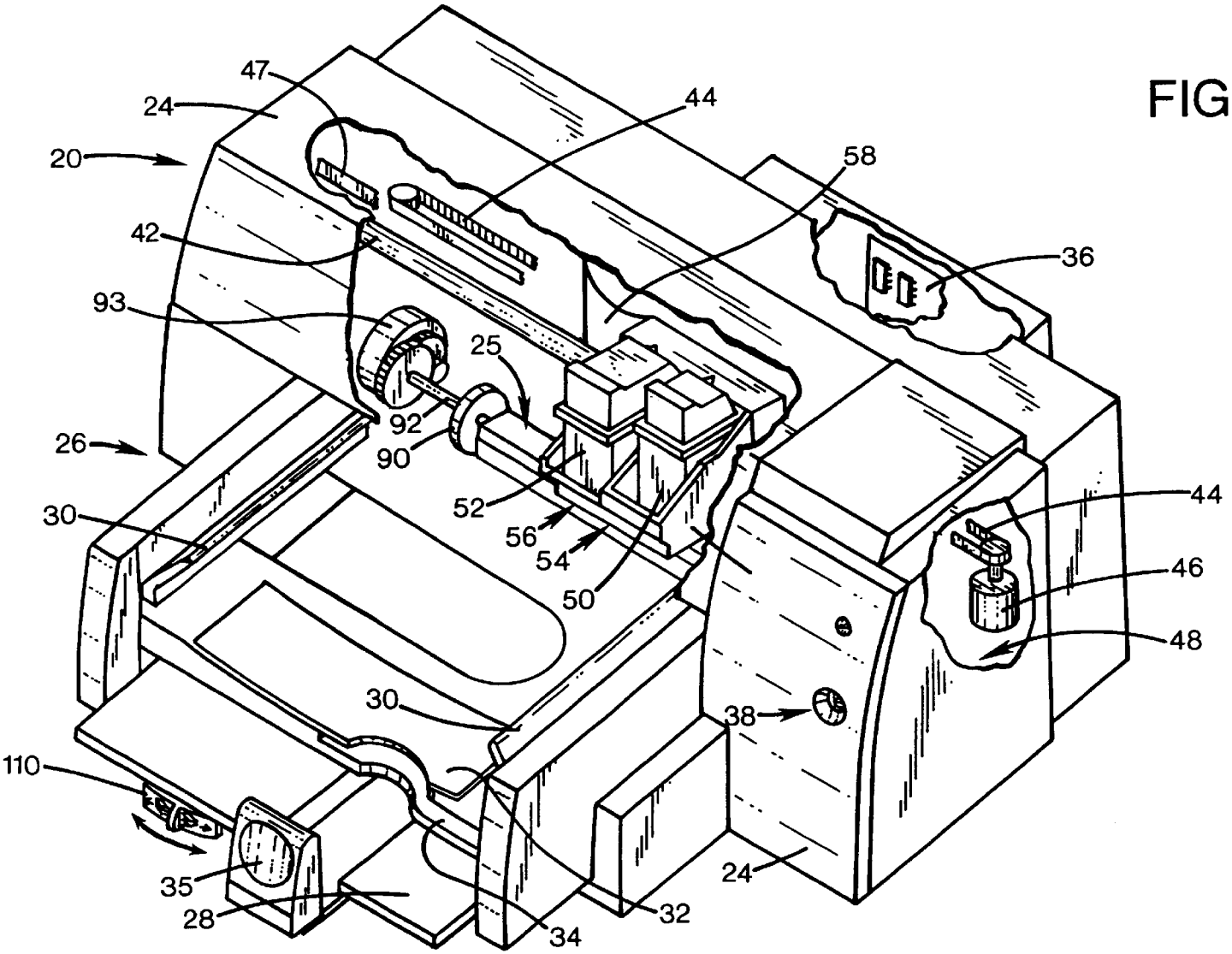
FIG. 1 is a fragmented perspective view of one form of an inkjet printing mechanism, here an inkjet printer, including one form of a Z-fold media handling system of the present invention.

FIG. 1 illustrates an embodiment of an inkjet printing mechanism, here shown as an inkjet printer 20, constructed in accordance with the present invention, which may be used for printing for business reports, correspondence, desktop publishing, artwork, and the like, in an industrial, office, home or other environment A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by an adaptive print media handling system 26, constructed in accordance with the present invention for feeding both cut-sheet and Z-fold stacks of media. The print media may be any type of suitable sheet material, such as paper, card-stock, transparencies, mylar, and the like, but for convenience, the illustrated embodiment is described using paper as the print medium. The print media handling system 26 has a feed or input tray 28 for storing sheets of paper before printing. A series of motor-driven paper drive rollers described in detail below (items 90 FIGS. 4–16) may be used to move the print media from tray 28 into the printzone 25 for printing. After printing, the sheet then lands on a pair of retractable output drying wing members 30, shown extended to receive the printed sheet. The wings 30 momentarily hold the newly printed sheet above any previously printed sheets still drying in an output tray portion 32 before retracting to the sides to drop the newly printed sheet into the output tray 32. The media handling system 26 may include a series of adjustment mechanisms for accommodating different sizes of print media, including letter, legal, A-4, envelopes, etc., such as an envelope feed slot 34, and a sliding length adjustment lever 35.

The printer 20 also has a printer controller, illustrated schematically as a microprocessor 36, that receives instructions from a host device, typically a computer, such as a personal computer (not shown). Indeed, many of the printer controller functions may be performed by the host computer, by the electronics on board the printer, or by interactions therebetween. As used herein, the term "printer controller 36" encompasses these functions, whether performed by the host computer, the printer, an intermediary device therebetween, or by a combined interaction of such elements. The printer controller 36 may also operate in response to user inputs provided through a key pad 38 located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A inkjet printhead carriage 40 is slideably supported by a guide rod 42 for travel back and forth across the printzone 25 when driven by a carriage propulsion system, here shown as including an endless belt 44 coupled to a carriage drive DC motor 46. The carriage propulsion system may also have a position feedback system, such as a conventional optical encoder system, which communicates carriage position signals to the controller 36. For instance, an optical encoder reader may be mounted to carriage 40 to read an encoder strip 47 extending along the path of carriage travel. The carriage drive motor 46 then operates in response to control signals received from the printer controller 36. One suitable carriage system is shown in U.S. Pat. No. 4,907,018, assigned to the present assignee, the Hewlett-Packard Company.

The carriage 40 is also propelled along guide rod 38 into a servicing region, as indicated generally by arrow 48, located within the interior of the casing 24. The servicing region 48 may house a conventional service station (not shown), which may provide various conventional printhead servicing functions as described in the Background portion above. A variety of different mechanisms may be used to selectively bring printhead caps, wipers and primers (if used) into contact with the printheads, such as translating or rotary devices, which may be motor driven, or operated through engagement with the carriage 40. For instance, suitable translating or floating sled types of service station operating mechanisms are shown in U.S. Pat. Nos. 4,853,717 and 5,155,497, both assigned to the present assignee, Hewlett-Packard Company. A rotary type of servicing mechanism is commercially available in the DeskJet® 820C and 870C color inkjet printers, sold by the Hewlett-Packard Company.

In the printzone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta The black ink pen 50 is illustrated herein as containing a pigment based ink. It is apparent that other types of inks may also be used in pens 50, 52, such as paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which has an orifice plate with a plurality of nozzles formed therethrough in a manner well known to those skilled in the art. The illustrated printheads 54, 56 are thermal inkjet printheads, although other types of printheads may be used, such as piezoelectric printheads. The printheads 54, 56 typically include a substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip 58 from the controller 36 to the printhead carriage 40, and through conventional interconnects between the carriage and pens 50, 52 to the printheads 54, 56.

Z-Fold Print Media Handling System

Figure 2:
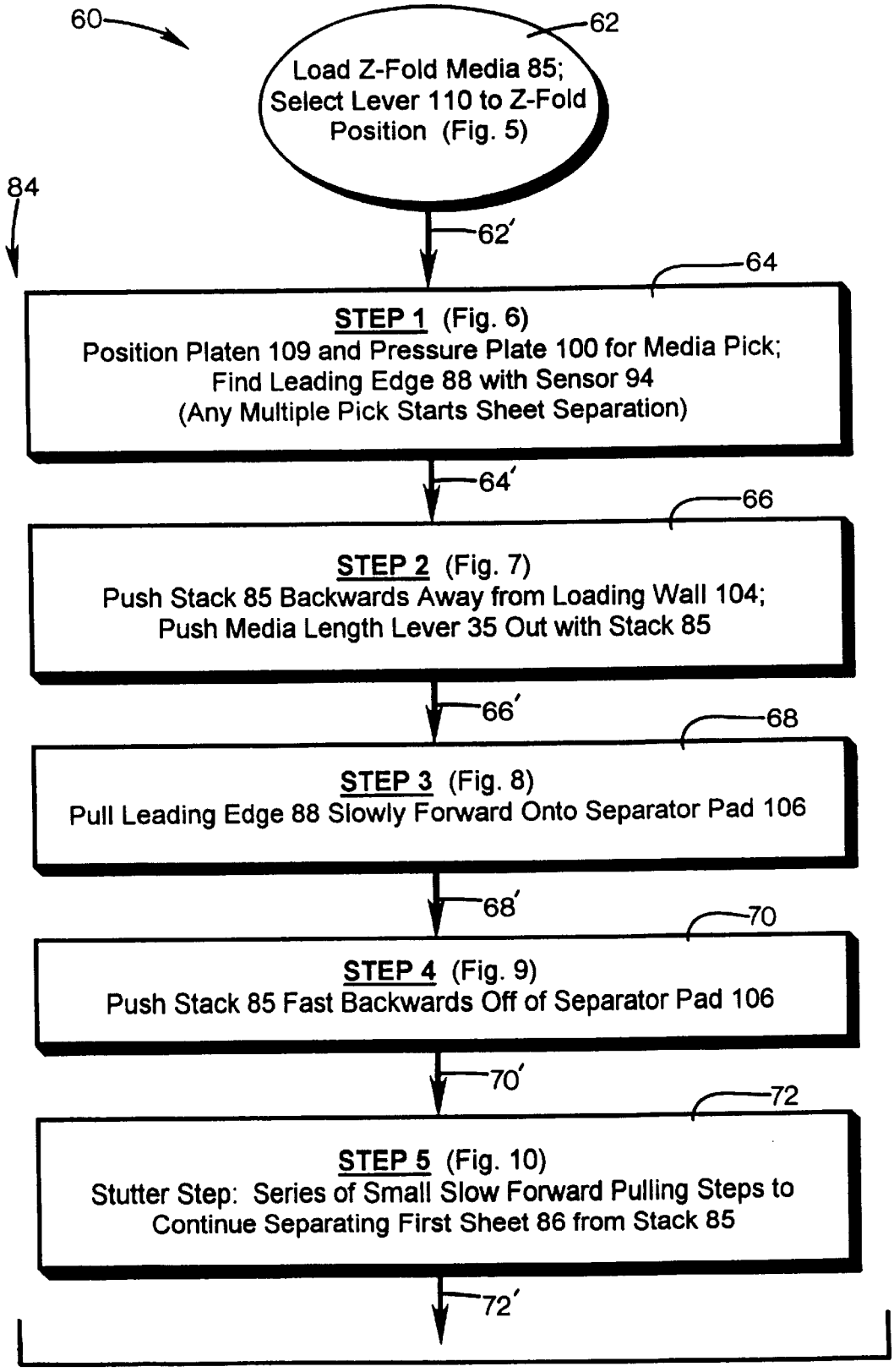
FIGS. 2–3 are adjoining portions of a flow chart illustrating one form of a method of operating the Z-fold media handling system of FIG. 1, including an initial loading step, followed by steps 1 through 9, and ending with a printing step.
Figure 3:
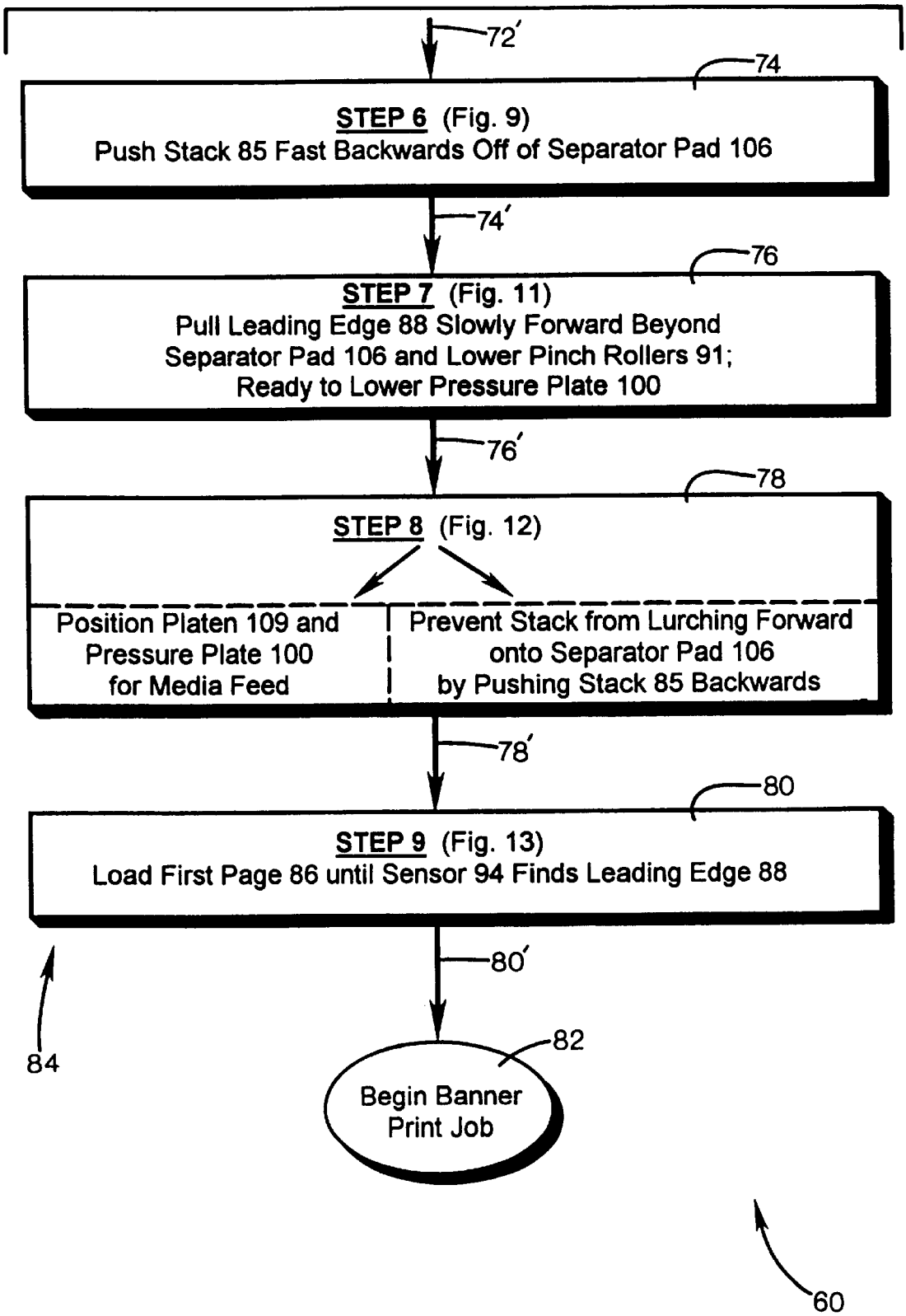

FIGS. 2 and 3 together form a flow chart 60 which illustrates one manner of operating the Z-fold media handling system 26 in accordance with the present invention. The method starts with the user loading media into the input tray 28 as an initial step, followed by Steps 1 through 9, which are assigned item numbers 64, 66, 68, 70, 72, 74, 76, 78 and 80 respectively, with the final step of beginning the print job being indicated as item number 82. In flow chart 60, the first through the ninth steps 64–80 together define one form of a Z-fold media feeding routine 84 in accordance with the present invention.

Figure 4:
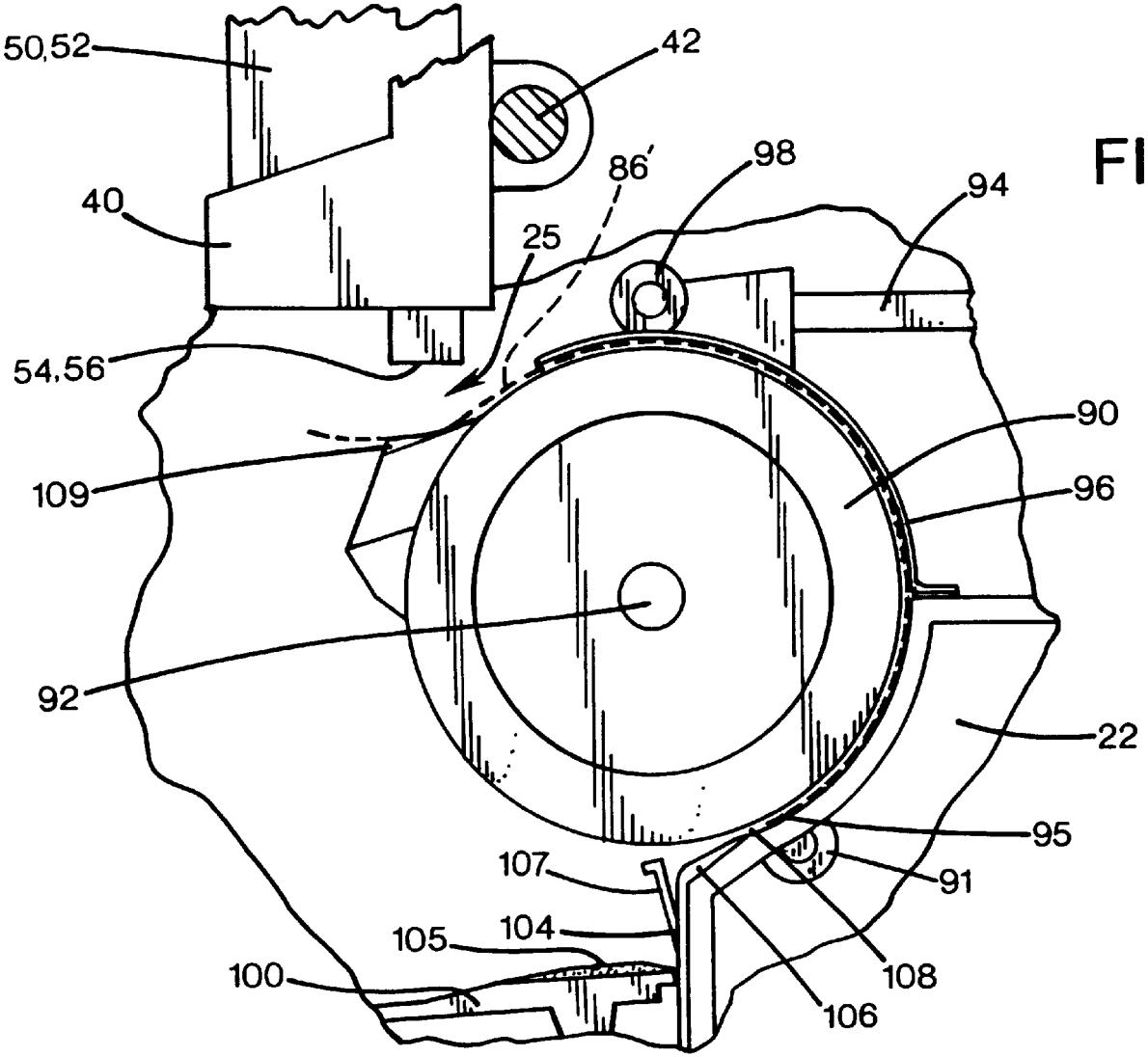
FIG. 4 is an enlarged side elevational, sectional view of the components of the Z-fold media handling system of FIG. 1.
Figure 5:
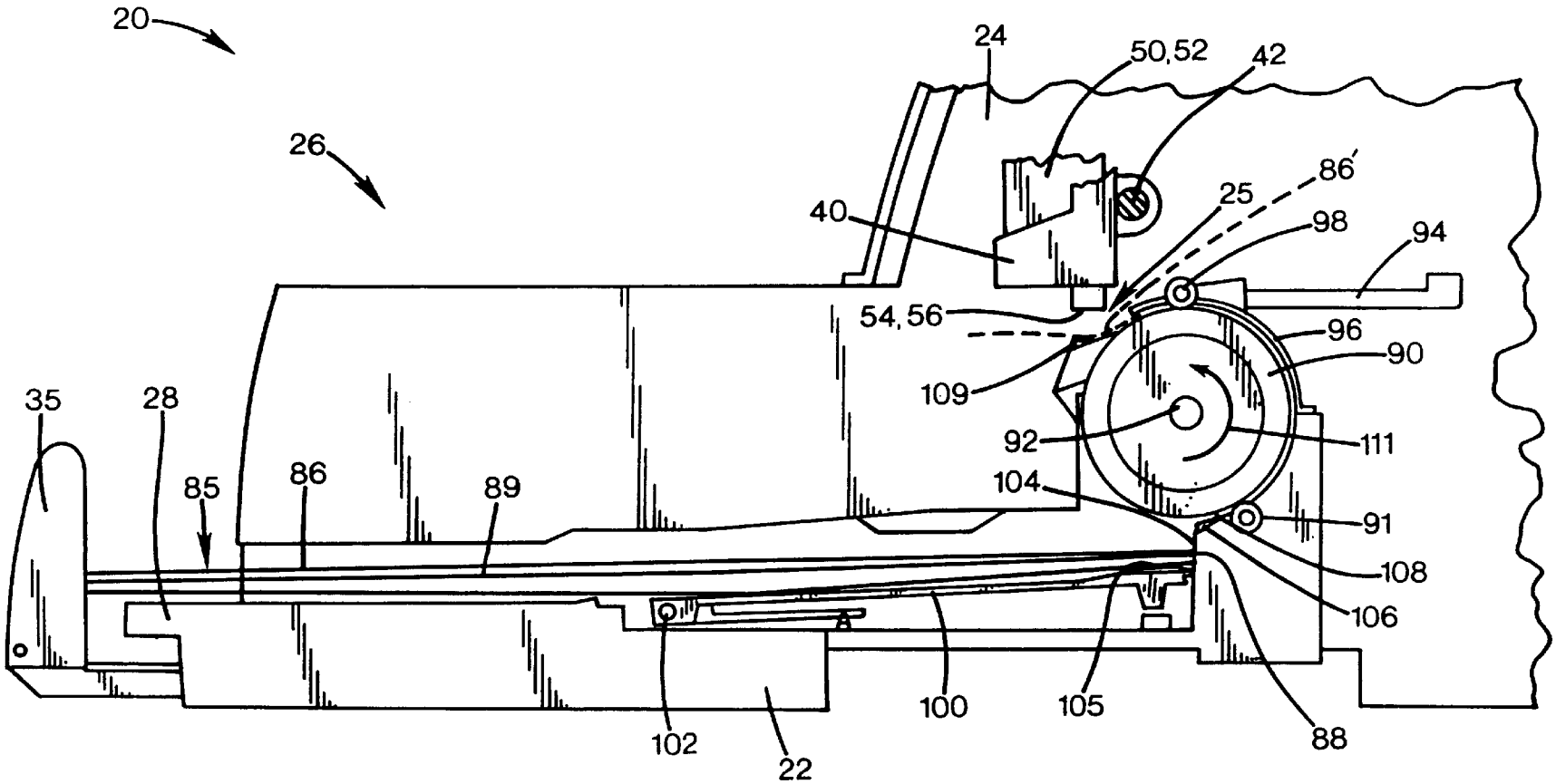
FIGS. 5–13 are fragmented, sectional, side elevational views of the Z-fold media handling system of FIG. 1, showing various stages of operation according to the flow chart of FIGS. 2 and 3, as follows.

To accomplish the Z-fold feeding routine 84, the Z-fold media handling system 26, shown in detail in FIG. 4, may be used, although it is apparent that other inkjet printing mechanisms may be used to implement the illustrated method 84. FIG. 5 shows the initial step 62, where a stack of Z-fold media 85 is loaded into the input feed tray 28. The Z-fold stack 85 includes an upper or first sheet 86, which has a leading edge 88. The other end of the first sheet 86 is attached at a fold to a second sheet 89 of stack 85, etc., for the desired number of sheets in the stack. Usually the sheets are connected together with a series of perforations along the folds, which allow the sheets to be easily torn apart by hand to separate the sheets of one print job from the remainder of the Z-fold supply. The trailing edge of the Z-fold stack 85 may be located at either end of the input feed tray 28, that is adjacent the length adjuster 35, or at the opposite end of the feed tray 28.

In FIG. 4, the Z-fold media handling system 26 is shown as including a drive roller 90, which may be a single roller or several discrete rollers, preferably three or four such rollers 90 (see FIG. 14), and a lower pinch roller 91 preferably adjacent each of the drive rollers 90. The drive rollers 90 may be mounted along a common shaft 92, which may be coupled to a conventional drive motor and gear assembly, such as a stepper motor assembly 93 (see FIG. 1). In response to instructions received from controller 36 via a control signal, the stepper motor 93 incrementally advances the drive rollers 90 to pull a sheet of media into the printzone 25 where it receives ink selectively ejected from pens 50, 52. Each incremental advance of the drive motor 93 is referred to in the art as a "step," which is not to be confused with the various stages or "steps" 64–80 of the Z-fold media feed routine 84. It is apparent that other types of media drive motors may also be used, such as an encoded DC (direct current) drive motor to incrementally advance the media The concepts illustrated herein may be applied to these different types of motors with various modifications that are within the capabilities of those skilled in the art. For instance, when using a DC motor, an encoder feed back system may be used to determine the relative degree of travel of the media through the printer, rather than counting motor steps.

A media sensor 94 may be mounted along the upper periphery of the drive roller 90. The media sensor 94 provides feed-back to the controller 36 as to when the media leading edge 88 has passed through a feed path 95 from under a media guide 96 and into contact with an upper pinch roller or rollers 98. The upper pinch rollers 98 assist to guide the media downwardly into the printzone 25, as indicated by the dashed line 86' in FIGS. 4 and 5.

The Z-fold media handling system 26 includes a raiseable pressure or lift plate 100, which lays along a portion of the underside of the input tray 28, and is pivoted to the chassis 22 at a pair of pivot attachment points 102. As shown in FIG. 5, the stack of media 85 is loaded into printer 20 to overlay the pressure plate 100, with the stack pushed forward until the leading edge 88 of the top sheet 86, as well as the edges of each sheet in the stack under edge 88, are in contact with a loading wall 104. As best shown in FIG. 4, the pressure plate 100 carries a first friction member, such as a cork pad 105 located along an upper surface of the pressure plate 100, adjacent the loading wall 104. A second friction member, here, a friction separator pad member 106, is mounted on the chassis 22 along a portion of the loading wall 104, preferably adjacent a conventional kicker member 107. The kicker 107 normally is spring-biased into a kicking position, which is also the rest state of the kicker. As a sheet of media passes over kicker 107 from the feed tray 28 to the printzone 25, the spring (not shown) is stressed and the kicker is pushed into a feed position within a recess in the loading wall 104. The kicker 107 is shown pivoted outwardly in FIG. 4 into the kicking position to push cut-sheets of media back into the input tray 28.

In a conventional cut-sheet feeding system, the media feed path 95 begins at the input tray 28 where the pressure plate 100 raises to bring a single sheet of cut media into contact with the drive rollers 90. The drive rollers 90 then pull the single sheet of cut media through the feed zone entrance 108, between the drive rollers 90 and lower pinch rollers 91. The rollers 90 continue to pull the sheet under guide 96, past the media sensor 94, under the upper pinch rollers 98, then downwardly as indicated by dashed line 86' into the printzone 25. In the printzone 25, the media sheet is supported by a media support member, such as a platen member or pivot assembly 109, preferably with a reverse-bowed concave tensioning between the pinch rollers 98 and the pivot 109, which provides a desired printhead to media spacing between the printheads 54, 56 and the sheet of media in the printzone 25.

After each pass of the carriage 40 across the printzone 25, the media is then advanced by continuing to turn the drive rollers 90 in a forward or loading direction, here defined in FIGS. 5–13 as being a counterclockwise direction indicated by curved arrow 111. The media sheet is incrementally advanced through the printzone 25 until the entire image has been printed through consecutive passes of the printheads 54, 56 over the media. Upon completion of the print job, the printed sheet is ejected onto the output wings 30, where it dries momentarily before being lowered onto the output tray 32. When printing on a stack of Z-fold media 85, advantageously this same feed path 95, from the entrance 108 to the output on wings 30, is used with the illustrated media handling system 26.

When printing on a series of consecutive cut-sheets, the kicker 107 is activated between sheets, as well as after the trailing edge of the last sheet passes over the kicker, whether this last sheet is cut-sheet media or the end of a Z-fold banner print job. Typically the body of the sheet of media, between the leading and trailing edges, holds the kicker in the feed position within its storage recess in the loading wall 104. When the trailing edge passes over the kicker, the kicker is released to travel to the kicking position. When released, the kicker 107 rotates out, of its storage recess and pushes the remainder of the cut-sheet stack back into the input tray 28 to prevent a multiple pick.

The separator pad 106 also plays a major roll in preventing cut-sheet double picks, which are a commonly occurring subset of the multiple pick phenomenon. In a double pick scenario, two sheets of media are advanced by the drive rollers 90 toward the feed path entrance 108. The lower sheet encounters the high-friction separator pad 106. The separator pad 106 grips the lower sheet while the drive rollers 90 continue to advance the upper sheet toward the feed path entrance 108. Since the coefficient of friction between the upper and lower sheets of media is less than the coefficients between the upper sheet and drive rollers 90, and between the lower sheet and the separator pad 106, the upper and lower sheets are pulled apart The upper sheet continues through the feed path 95 to the printzone 25, with the trailing edge of the upper sheet activating the kicker 107, which then pushes the lower sheet back into the input tray 28.

Thus, in a cut-sheet media feed system, sheet-to-sheet media separation basically occurs on the separator pad 106. The portion of method 84 for sheet-to-sheet separation of Z-fold media is quite different from the cut-sheet separation scheme. Here, the term "separation" refers to the relative sliding apart of adjacent sheets in the input tray 28, with an initial goal in Z-fold feeding being forward movement of the leading edge 88 toward the feed path 95, while leaving the remainder of the stack 85 in the input tray 28. In the Z-fold feeding routine 84, sheet-to-sheet separation is primarily accomplished before the Z-fold media encounters the high friction separator pad 106 on the way toward the printzone 25 for printing. In the Z-fold scheme, the friction member on the pressure plate 100, here the cork pad 105, is primarily responsible for sheet-to-sheet separation, as described in further detail below. Thus, in the Z-fold routine, the majority of the sheet-to-sheet separation action occurs upstream (at pad 105) from the location (at pad 106) of the conventional separation action for cut-sheet media. Indeed, one of the primary functional goals used in implementing routine 84 is to keep the media stack 85 off of the separator pad 106, although the leading edge 88 is allowed to travel back and forth over the separator pad 106 during different stages of the routine, as described below.

FIG. 5 shows the completion of the initial operator involvement at step 62, where the Z-fold stack of media 85 has been loaded into feed tray 28 and pushed against the loading wall 104. At this stage, the operator also moves a media select or "banner" lever 110, located under the input tray 28, to the right as shown in FIG. 1. To assist the operator in remembering which way to move the lever 110 for cut-sheet and Z-fold banner-type media, the lever advantageously has a Z-fold icon appearing on right side of the lever 110, and a cut-sheet icon appearing on the left side. Thus, to return to normal cut-sheet feeding, the operator moves the lever 110 to the left. It is apparent that the lever 110 may be located in a variety of other locations, although by placing it at the input tray 28 it is readily apparent to the operator while loading media, making it more likely that the operator will remember to move the lever when changing types of media Indeed, the operation of the media select lever 110 may be totally eliminated in some embodiments, having the selection occur at a host computer which then communicates with the printer controller 36 to shift to the desired type of media. Such a selection from the host computer may be made manually by an operator, or it may be automatically transmitted to the printer controller 36 depending on the size and type of image being printed. In the illustrated embodiment, the media select lever 110 operates to adjust the printhead-to-media spacing, as described further below with respect to FIGS. 14–16.

The Z-fold media handling system 26 and method 84 will now be described with respect to flow chart 60 in FIGS. 2 and 3, and the illustrated printer 20 in FIGS. 4–13. After the Z-fold media stack 85 has been loaded into the input tray 28 (FIG. 5), and the media select lever 110 moved to the Z-fold position, the operator may then initiate a print job from a host computer, as indicated by arrow 62' in flow chart 60.

Figure 6:
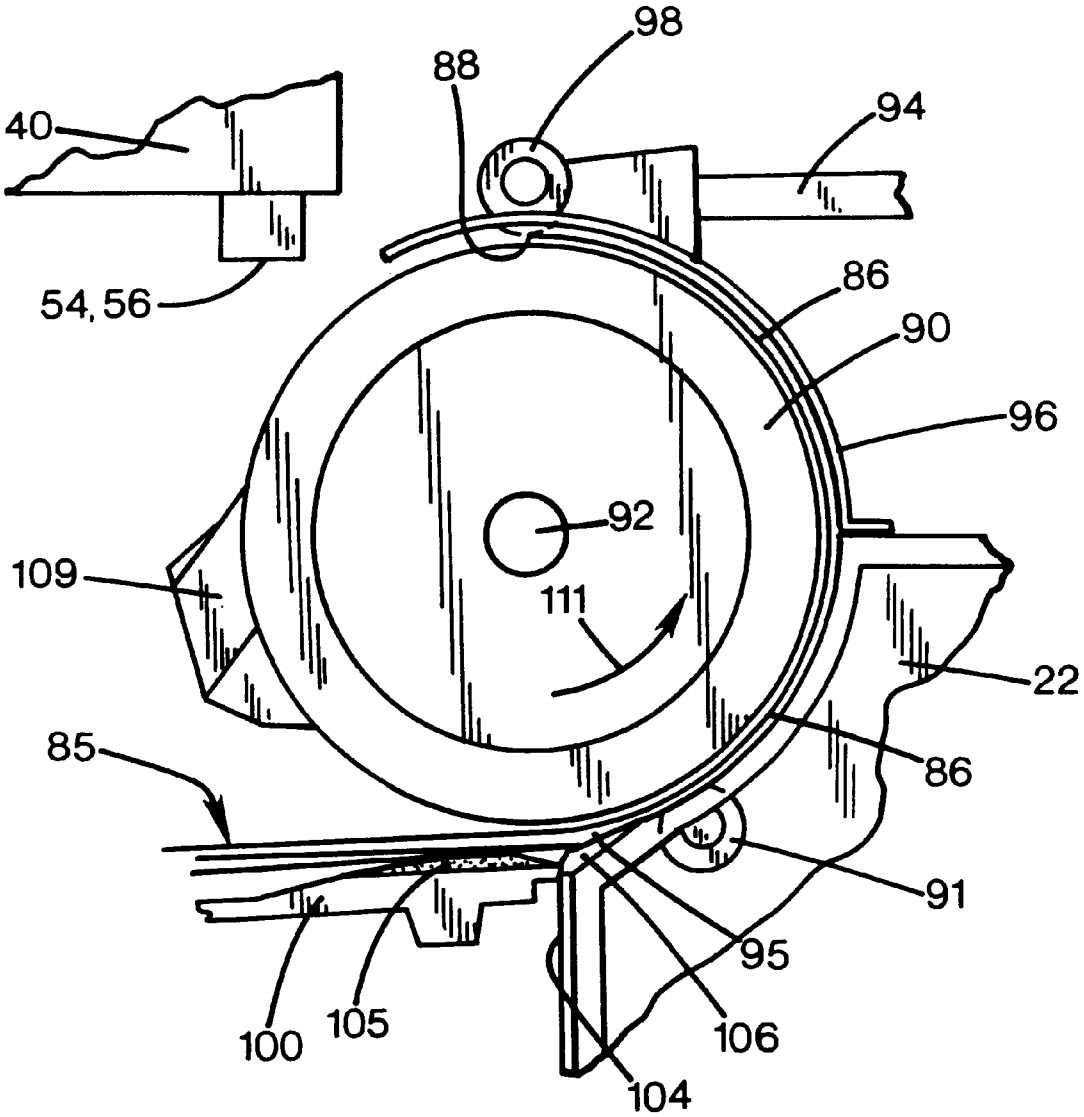

As shown in FIG. 6, the first step 64 comprises a registering step to indicate to the controller 36 where the leading edge 88 of the banner paper 85 is located. In the first step 64, with the lift plate 100 elevated and the pivot 109 lowered to their pick positions, the drive rollers 90 rotate in the forward direction 111 to move the leading edge 88 of the first media sheet 86 through the feed path 95 and into contact with media sensor 94. Sometimes only the first sheet 86 is pulled into the printzone, but other times, particularly if the Z-fold stack is only a few sheets thick, the entire stack 85 is pulled into the feed path 95. Even if the entire stack 85 is pulled through, sensor 94 still registers the location of the leading edge. While pulling of the entire stack 85 through feed path 95 may at first blush seem like a malfunction, quite to the contrary, it is an advantage in beginning sheet-to-sheet separation in the media stack 85 because it creates a relative motion between adjacent sheets. When bending the whole stack 85 around the drive rollers 90, the angular velocity of the sheets is the same, but the surface velocity of adjacent sheets changes as they are pulled around the drive rollers 90. That is, the inner-most first sheet 86 has a lesser distance to travel around rollers 90 than the second sheet 89, the second sheet has a lesser distance to travel than the third sheet, etc., so these adjacent sheets begin to separate from one another during such an initial Z-fold multiple pick. Using conventional plain Z-fold paper, these multiple Z-fold picks of the entire stack are believed to occur about 20% of the time, whereas, if the stack is pressed together, for instance, manually, then this Z-fold multiple pick may occur at a frequency of about 80%.

At the end of the first step 64, the media sensor 94 relays information on the location of the leading edge 88 back to the controller 36. Once this initial position of the Z-fold leading edge 88 is registered by the controller 36, the second step 66, as well as the remaining steps 68–80, may be performed reliably. That is, upon finding the leading edge 88, the controller 36 then starts counting the number of motor steps in routine 84 from a zero reference corresponding to the location of the leading edge at the sensor 94. Each motor step corresponds to an incremental move of the media, here, approximately equal to 0.085 millimeters (1/300 inch). Upon completion of the first step 64, a signal 64' is communicated to initiate the second step 66.

Figure 7:
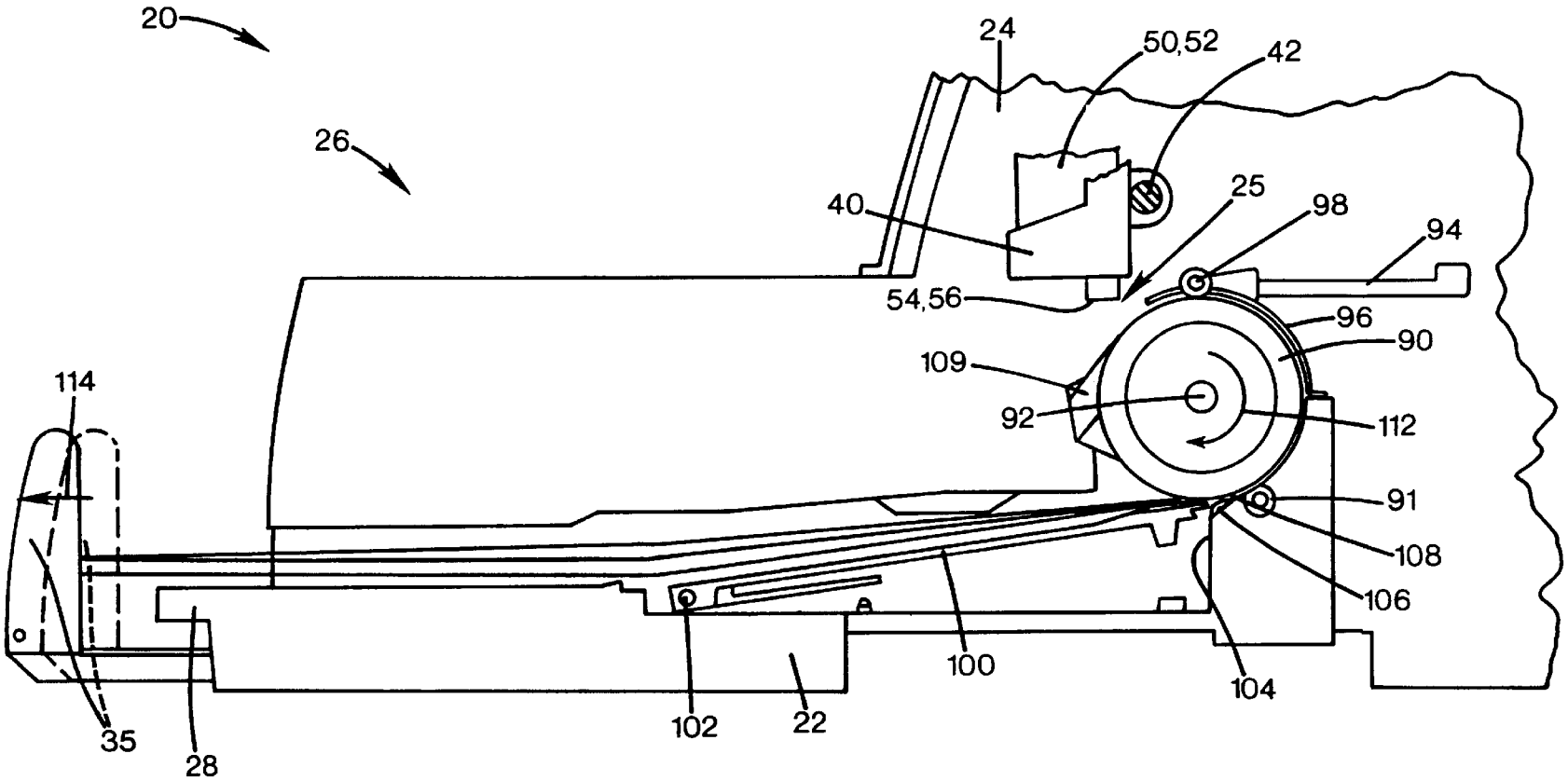

In FIG. 7, the second step 66 comprising an unloading step is shown as the drive rollers 90 rotate in a backwards or unloading direction (counterclockwise in the FIGS. 4–13), as indicated by curved arrow 112. Preferably, the drive rollers 90 rotate backwards at a normal speed. Several relative media movement speeds are used here to described the illustrated embodiment of the Z-fold feed routine 84. As used herein, a "fast speed" is as fast as the drive motor 93 can go without damaging the media or at a speed which is typically limited by the efficiency of the particular motor selected for a given implementation. In the illustrated embodiment, this fast speed is on the order of 12.2 centimeters per second (4.8 inches per second), compared to a normal speed of around 8.4 centimeters per second (3.3 inches per second). From the development work conducted by the inventors, it appears that the faster this "fast" speed is, the better the Z-fold pick routine 84 will perform. In later steps, the speed of the drive rollers 90 is described as a "slow speed," such as when moving the media forward. Here, the relative degree of "slow" for the best performance the inventors found to be as slow as possible. For instance, the illustrated motor 93 has a slow speed of about 2.0 centimeters per second (0.8 inches per second). It is apparent that there may be other practical limits on the fastest "fast" speed and on the slowest "slow" speed as improvements in motor performance standards are made, but these practical limits will become apparent to those skilled in the art when practicing the concepts illustrated herein. For instance, "too slow" may be the point where throughput performance is severely degraded for minimal benefits in sheet-to-sheet separation; whereas "too fast" may be the point where the media is crumpled, rather than merely pushed backwards.

In the second step 66, this backward motion of the drive rollers 90, preferably at a normal speed, here 8.4 centimeters per second (3.3 inches per second), pushes the remainder of the Z-fold stack 85 rearwardly in an unloading motion from the feed path entrance 108 and against the length adjuster 35 at the front of the printer. Indeed, preferably the stack 85 actually moves the length adjuster 35 outwardly away from the printer chassis 22, as indicated by arrow 114, from the initial position shown in dashed lines to the final position shown in solid lines in FIG. 7. For example, for conventional letter size Z-fold media 85, the length adjuster 35 is moved approximately 1.514 3.0 millimeters in the direction indicated by arrow 114. Using a conventional stepper motor assembly 93 of the type typically employed in the inkjet printer 20, the motor 93 moves back-wards a certain number of steps to propel the drive rollers 90 in the unloading direction 112. The number of steps selected is not only dependent upon the type of motor 93, but also the diameter of the drive rollers 90 and the configuration of any other components between the input tray 28 and the printzone 25. In the illustrated embodiment for printer 20, in the second step 66, the stepper motor moves backwards a number of steps selected from the range of 1000–1200, with an optimal number of steps for printer 20 being on the order of 1100 steps. It is apparent to those skilled in the art that the number of steps noted herein for practicing method 84 are given by way of illustration only with respect to the printer 20 embodiment, and that the number of steps will vary for different printing mechanism designs. In the illustrated embodiment, one step of the stepper motor 93 is approximately equal to 0.085 millimeters (1/300 inch). This rearward motion of the Z-fold stack 85 moves the media off of the friction separator pad 106 at the top portion of the loading wall 104. In the illustrated embodiment, the leading edge 88 of the Z-fold stack 85 is moved approximately 1.5–3.0 millimeters away from the loading wall 104 during the second step 66. Upon completion of the second step 66, a signal 66' is generated to initiate the third step 68.

Before discussing the remainder of the steps 68–80, it may be helpful to insert Table 1 which lists the direction of motion of rollers 90, along with the speed and number of steps of the stepper motor 93 which may be used to accomplish the desired Z-fold media pick routine 84 using the illustrated printer 20. These values are given by way of example only, and they may vary between different types of printing mechanisms; however, the exact selection of motor speed and steps is believed to be within the level of ordinary skill in the art, once the manner of conducting pick routine 84 is understood with reference to the illustrated embodiment. Indeed, using a single speed throughout may even be suitable in some embodiments, although the illustrated embodiment is preferred, particularly when using inkjet printer 20.

TABLE 1

Illustrated Drive Roller Directions, Drive Motor Speeds and Distances by Method Step

| Method Step | Roller Direction | Motor Speed | Range of Motor Steps | Optimum Motor Steps |
|---|---|---|---|---|
| 1 | Forward | Normal | Until Leading Edge is Found | Until Leading Edge is Found |
| 2 | Backward | Normal | 1000–1200 | 1100 |
| 3 | Forward | Slow | 150–250 | 200 |
| 4 | Backward | Fast | 150–250 | 200 |
| 5 | Forward | Slow Stutter Steps | 5–15 Repeated 15–25 Times | 8 Repeated 20 Times |
| 6 | Backward | Fast | 100–180 | 140 |
| 7 | Forward | Slow | 750–900 | 830 |
| 8 | Backward | Normal | 400–600 | 500 |
| 9 | Forward | Normal | Until Leading Edge is Found | Until Leading Edge is Found |

Figure 8:
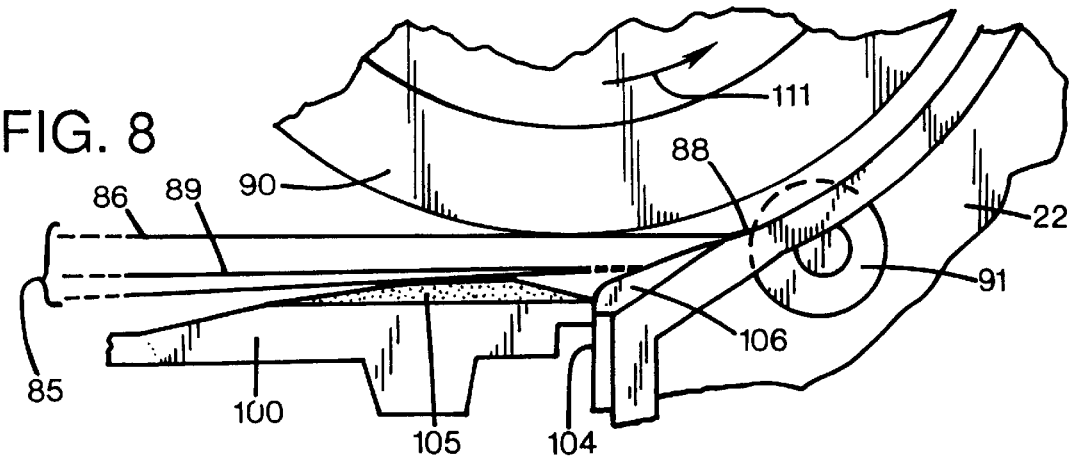

In FIG. 8, the third step 68 is a separating step where the Z-fold stack 85 is again moved forward by rotating drive rollers 90 in the counterclockwise direction of arrow 111 with the lift plate 100 elevated to a pick position. Preferably, this forward motion of drive rollers 90 is performed slowly for a number of motor steps selected according to Table 1, here approximately 200 steps. This slow forward motion of the drive roller 90 begins to separate the first page 86 from the balance of the media stack 85, using the friction generated by the cork friction member 105 on pressure plate 100 on the outer surface of the last sheet of the stack 85. That is, the cork pad 105 holds the stack 85 in place in the feed tray 28, while the elastomeric surface on the drive rollers 90 pulls the leading edge 88 of the top sheet 86 onto the separator pad 106 and away from the remainder of stack 85 to accomplish sheet-to-sheet separation. Here, the remainder of the stack 85 may remain on the cork friction pad 105 (solid lines in FIG. 8), or the stack 85 may land on the separator pad 106 (dashed lines in FIG. 8). Note in these steps, that the pressure plate 100 remains in a raised position with the cork friction pad 105 located adjacent a central one of the drive rollers 90 (see FIG. 14).

Figure 9:
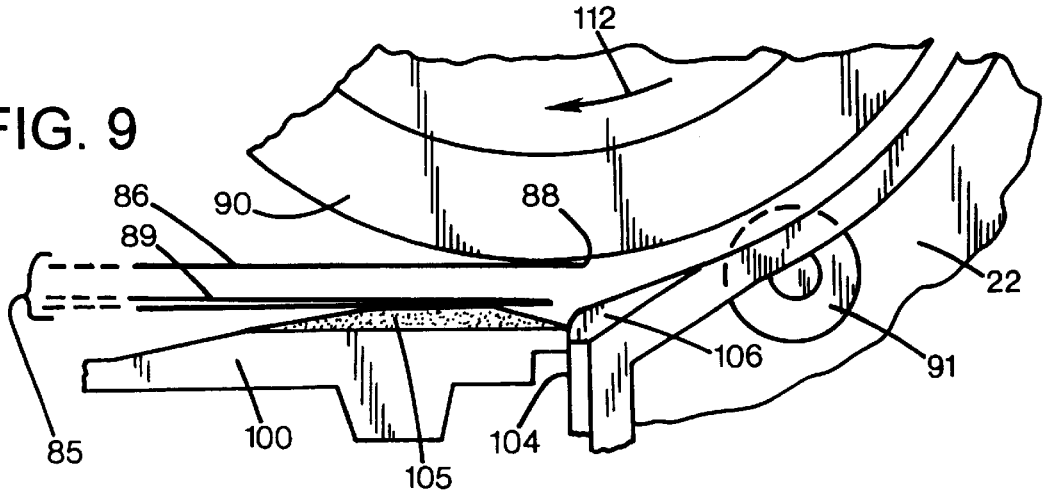

Upon completion of the third step 68, a signal 68' is issued to initiate the fourth step 70. The fourth step 70 comprises a stack pushing back step. As shown in FIG. 9, as the remainder of the stack 85 begins to approach the feed zone entrance 108, the drive rollers 90 have stopped and reversed in direction to rotate backward as indicated by arrow 112 at a fast speed (see Table 1), for preferably 200 motor steps. FIG. 9 shows the completion of this backwards travel of the stack 85. If the stack 85 is tightly compacted and acting as a single sheet, together the third and fourth steps 68, 70 (FIGS. 8 and 9) aid in sheet-to-sheet separation by driving the stack 85 over the friction separator pad 106. That is, if the bottom sheet also rides up on the separator pad 106 in the third step 68, this bottom sheet is momentarily gripped by the pad 106 as the drive rollers 90 begin first pushing the top sheets backwards (arrow 112) in the fourth step 70. During the fourth step 70, the entire stack 85 is eventually pushed off of the separator pad 106, as shown in FIG. 9. Upon completion of this pushing back of the media stack 85, a signal 70' is generated to initiate the fifth step 72.

Figure 10:
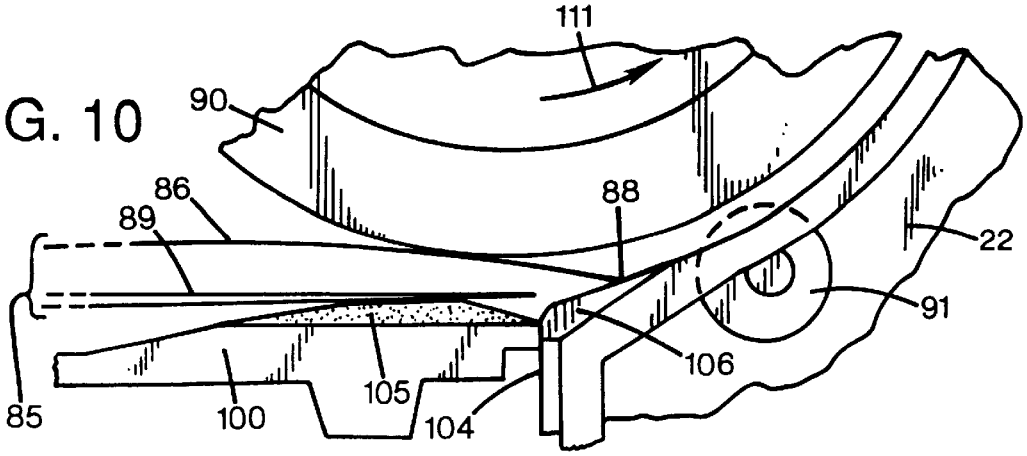

The fifth step 72 is illustrated in FIG. 10, where preferably a series of motor steps are initiated to continue separating the first media sheet 86 from the remainder of the stack 85. In the fifth step 72, a series of stopping and starting motions are performed, preferably 20 times, where the media drive rollers 90 are moved forward preferably at a slow pace as indicated in Table 1, typically for a very small duration of steps, on the order of 8 steps for each forward motion. Preferably, between each of the 20 forward slow steps, the motion of the drive roller 90 is paused or rested briefly for a short duration, for instance on the order of 50 milliseconds. This stopping and starting action of the fifth step 72 leads to a stuttering action of the drive roller, that is, the printer 20 sounds like it is stuttering, hence, the fifth step is referred to herein as a "stuttering step." This stuttering step 72 takes advantage of the difference between the effects of static friction and dynamic friction to separate the top sheet from stack 85. That is, static friction generated between the sheet 86 and roller 90 during the pause between the forward steps tends to be greater than the dynamic friction in the media handling system 26. Thus, the static friction generated during the pause provides a greater force to pull the top sheet away from the remainder of the sheets in the stack than if only a continual pulling action was provided by driving the rollers at a constant speed. This initial tugging action at the beginning of each stuttering forward step facilitates the separating operation to draw the initial sheet of media 86 into the feed path entrance 108.

Upon completion of the fifth step 72, a signal 72' is generated to initiate the sixth step 74, which shown in FIG. 9. The sixth step 74 is basically a repeat of the fourth step 70, which moves the balance of the Z-fold stack 85 away from the feed zone entrance 108. FIG. 9 shows the drive roller 90 rotating backward again, as indicated by arrow 112, at a fast speed selected according to Table 1. In the sixth step 74, preferably the drive motor 93 is moved 140 steps. This rearward or backing up motion of the remainder of stack 85 then facilitates operation of the next step. Indeed, together the fifth and sixth steps 72, 74 together act as the last opportunity to aid in sheet-to-sheet separation, similar to the pair of early separation steps, the third and fourth steps 68 and 70. Upon completion of the sixth step 74, a signal 74' is issued to initiate the seventh step 76.

Before continuing with a discussion of the remainder of the steps, it is worth mentioning one of the major hurtles the inventors encountered while developing the illustrated Z-fold handling routine 84. During developmental work on method 84, in addition to the multiple pick problem, another feed failure mode was encountered, one which may be called a "fold failure." In a fold failure, the Z-fold media folded over on itself in the area where the pages are connected together. Fold failures typically occurred during printing. While printing, the Z-fold paper is metered through the feed path 95 and a natural paper loop 116 (shown in dashed lines in FIG. 13) is created in the input tray. The size of loop 116 continues to get smaller as the loop approaches the feed zone entrance 108. As loop 116 passed along the perforations between joining sheets along the loading wall 104, occasionally the pick rollers 90 would grab the loop 116 before the media could unfurl, that is, before the media could straighten for feeding through the entrance 108. In grasping loop 116, the drive rollers 90 folded and flattened the loop, leaving a triple thick media region for about 0.5–1.5 centimeters across the width of the sheet, creating this "fold failure." After passing through the narrow feed path 95 and under both sets of pinch rollers 91 and 98, this triple folded region typically held its folded configuration as it passed under the printheads 54, 56. When unfolded by the operator, an unprinted band (a white band when printing on white media) appeared in the image at the location of the fold, often ruining the final image and requiring a total reprint of the image.

These fold failures usually occurred where the second page was attached to the third page, where the fourth page was attached to the fifth page, etc. Fold failures normally do not occur with cut-sheet media. When Z-fold media is picked and fed through the feed zone and a multiple pick has not occurred, fold failures started when the front edge of stack 85 was on top of the friction separator pad 106 instead of being butted against the loading wall 104 of the input tray 28. Thus, the goal in preventing not only multiple picks, but also to prevent fold failures, is to keep the balance of the stack 85 away from the separator pad 106. This is accomplished in part by using the cork friction pad 105 on the pressure plate 100 to hold the bottom of the stack 85 in place, while the drive rollers 90 push and pull the top sheets of the stack. This pushing and pulling of the top sheet 86 while holding the bottom of the stack still, separates the top sheet 86 for feeding into the path entrance 108, while the pushing backwards action (arrow 112) keeps the stack 85 off of the separator pad 106. By pushing the stack 85 backward away from the separator pad 106, fold failures are avoided.

Figure 11:
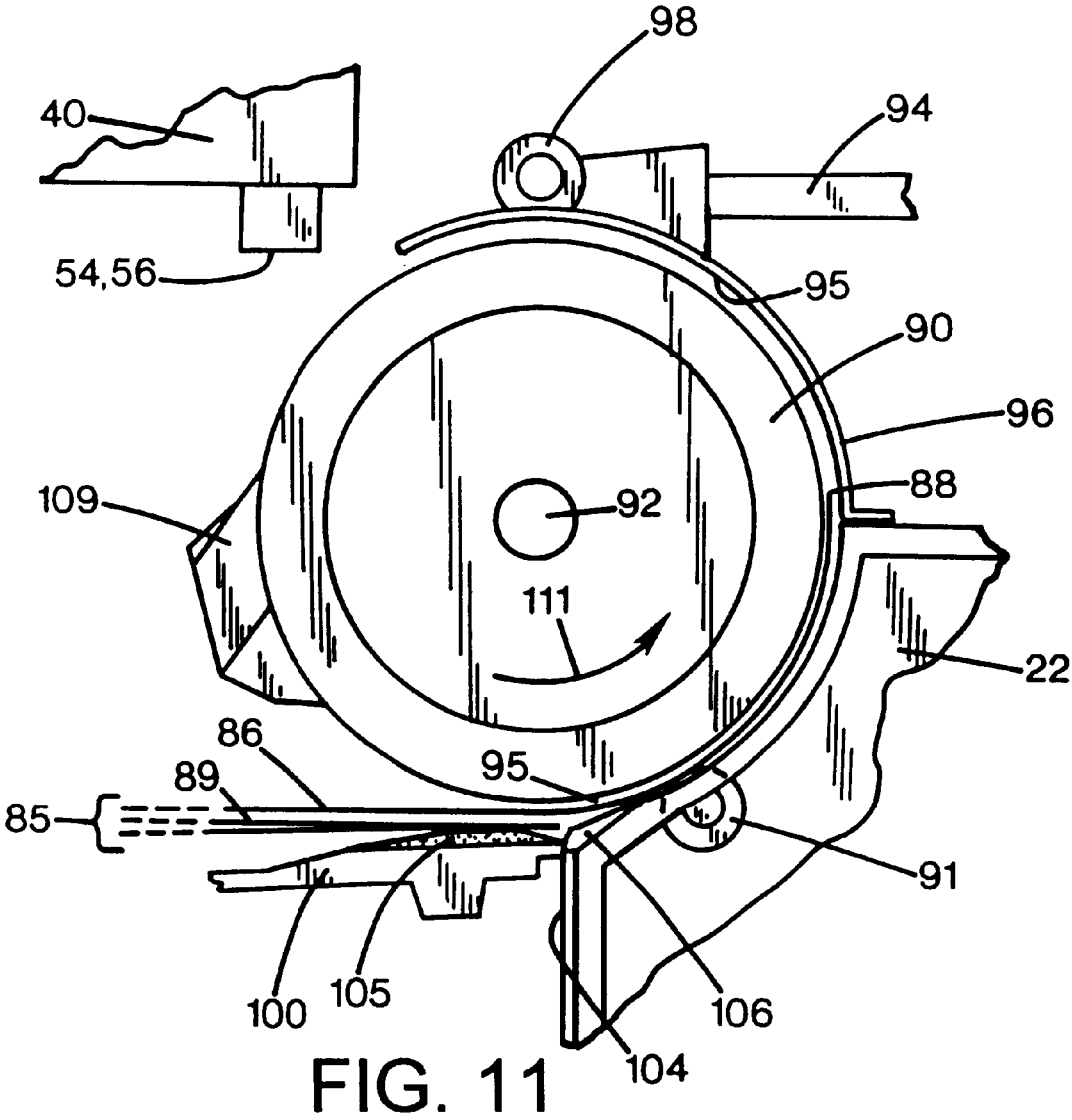

Moving ahead to FIG. 11 where the completion of the seventh step 76 is shown, the drive rollers 90 have again been rotated in the forward direction 111 at a slow pace, selected according to Table 1, preferably for an optimal duration of 830 steps of motor 93. This slow forward motion of the seventh step 76 continues to separate the top sheet 86 from the remainder of the Z-fold stack 85. Also during this seventh step 76, the leading edge 88 begins to move through the media feed-path 95 past the separator pad 106 and past the lower pinch rollers 94. In FIG. 11, the leading edge 88 is shown as being under guide 96, although during any particular feed operation, the leading edge 88 may end up at any location in feed path 95 between the lower pinch rollers 91 and the upper pinch rollers 98 (for FIG. 12, too). By this stage of operation, the majority of the time the stack 85 now stays off of the separator pad 105, as shown in FIG. 11, although occasionally during some pick routines the stack 85 may creep up onto the separator pad 106. Upon completion of the seventh step 76, a signal 76' is generated to initiate the eighth step 78.

Figure 12:
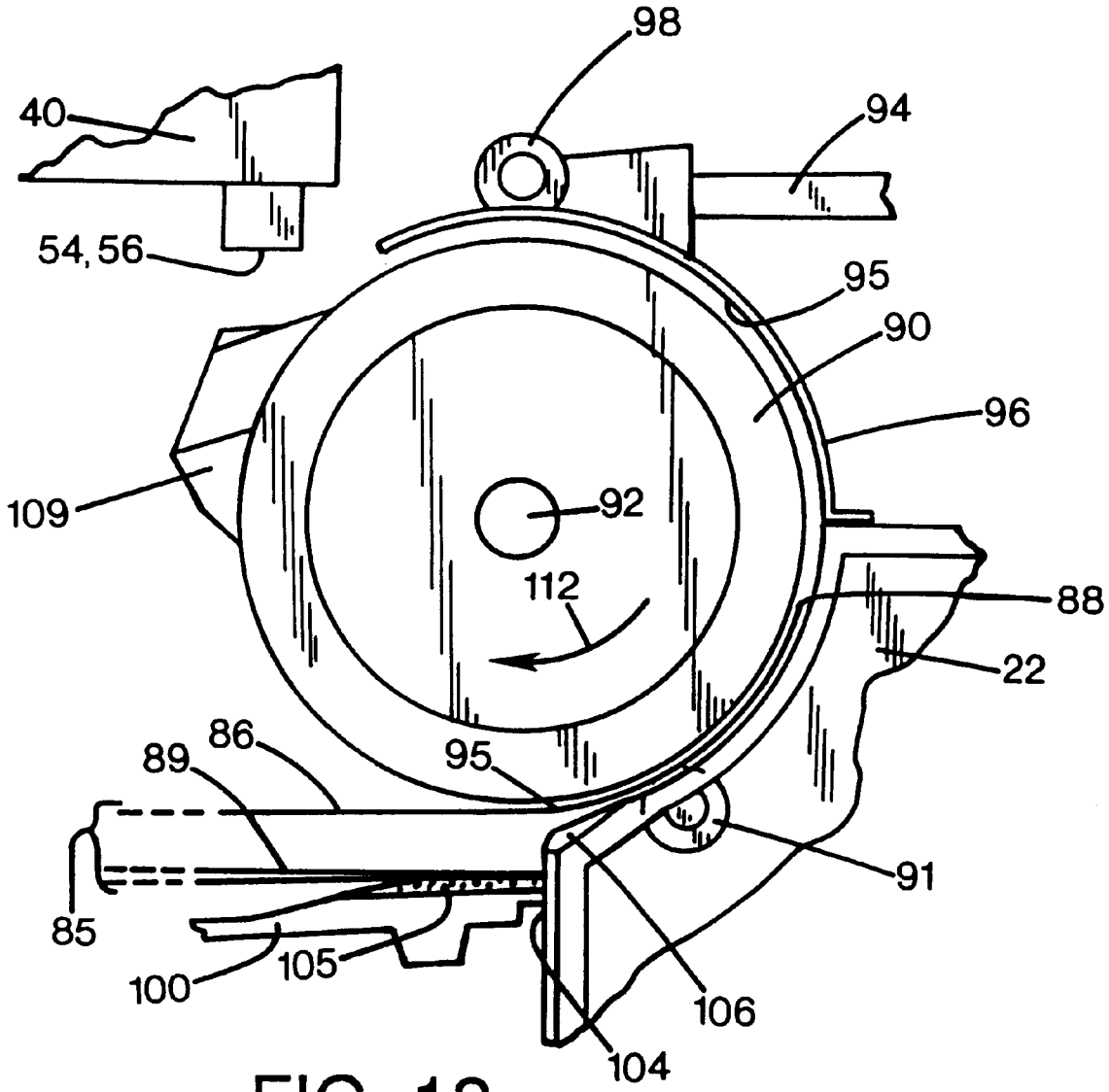

The eighth step 78 is illustrated in FIG. 12, where several actions occur together. For one, the drive rollers 90 rotate in the backwards direction 112 at a normal speed according to Table 1, preferably for approximately 500 steps of motor 93. Concurrently with this backward motion of the drive rollers 90, the printhead carriage 40 releases a media pick clutch 130 (see FIGS. 17–19), which allows the pivot 109 and pressure plate 100 to move to media feed positions. Preferably, the first sheet 86 is grasped between the drive rollers 90 and the lower pinch rollers 91 while the pressure plate 100 is lowered. As shown in FIG. 12, the pivot 109 has raised upwardly from the pick position to a preferred printhead-to-media spacing for printing on Z-fold paper. In FIG. 12, the pressure plate 100 has dropped to a feed position, so the front edges of the sheets in stack 85 are resting against the loading wall 104. The rearward motion of the drive rollers 90 pushes the leading edge 88 backwards to prevent the remainder of the Z-fold stack 85 from lurching forward onto the separator pad 106, which advantageously also avoids fold failures at the feed path entrance 108. Upon completion of the eighth step 78, a signal 78' is generated to initiate the ninth step 80.

Figure 13:
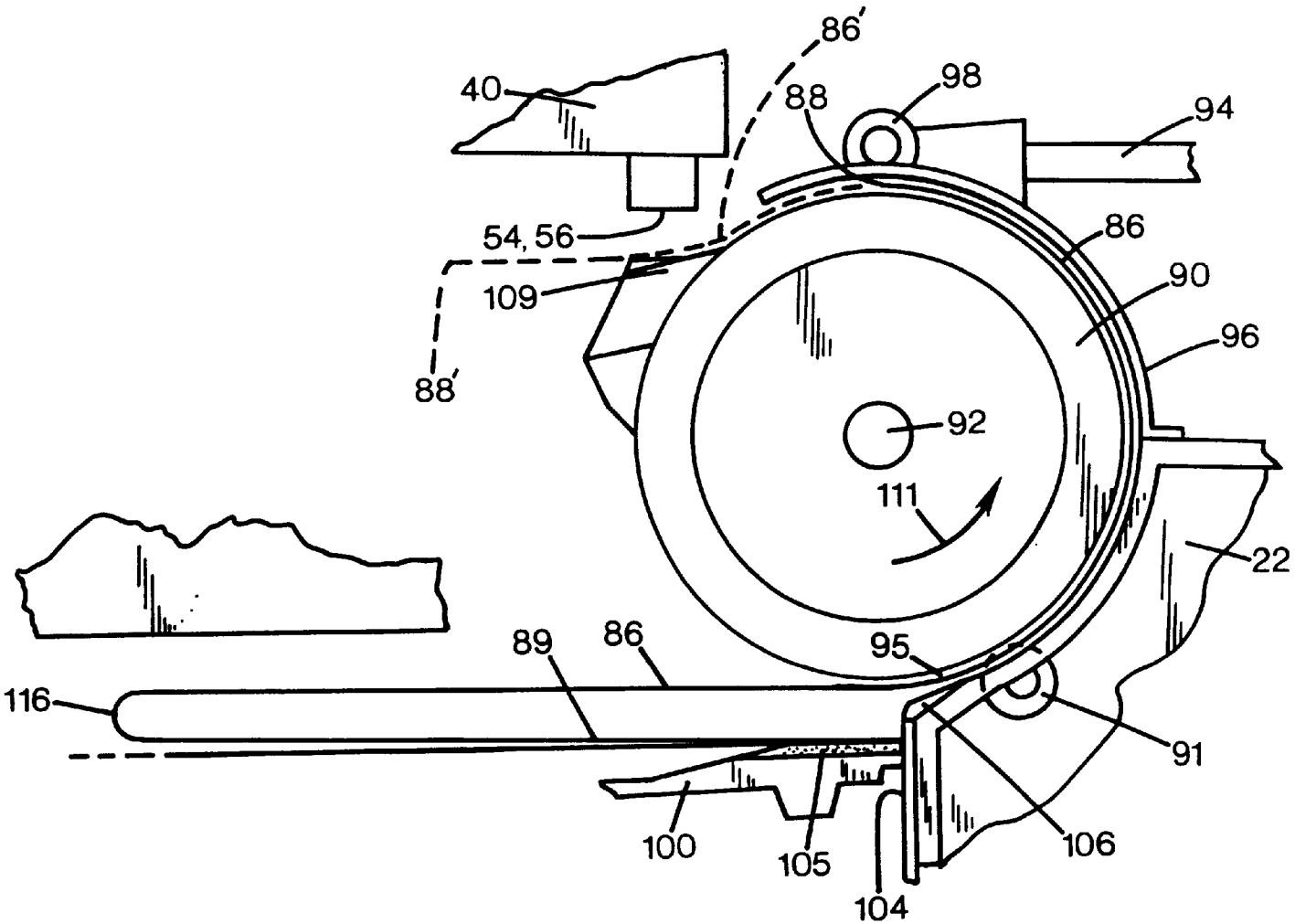

As shown in FIG. 13, during the ninth step 80 the drive rollers 90 rotate in a forward direction 111 to deliver the leading edge 88, 88' of the Z-fold stack 85 into the printzone 25. The lift plate 100 has been lowered to allow loop 116 to freely feed the remainder of the Z-fold stack through the feed path 95 and then into the printzone 25 to receive ink ejected from the printheads 54, 56, as indicated by the dashed line 86'. Upon delivery of the first sheet of media 86 to the printzone 25, the ninth step 80 issues a signal 80' to the printer controller 36, which then performs step 82, which is beginning the print job. In step 82, the forward motion 111 of the drive rollers continues at a pace determined by the printer controller 36 to print a selected image with optimum quality on the Z-fold sheet 85. Depending upon the print modes selected, the sheet 85 may be moved forwardly through the printzone 25 a full swath width, or at some incremental value thereof, for each pass of the printheads 54, 56 across the printzone. During the print job 82, no further backward motion (direction 112) of rollers 90 is performed because once started, the Z-fold stack 85 has been found to feed well from the input tray 28 without incurring multiple pick type jams or fold failures. While the rollers 90 could rotate backward during printing, it is believed that such motion may lead to print defects, so only forward motion 111 is used during the printing step 82.

Figure 14:
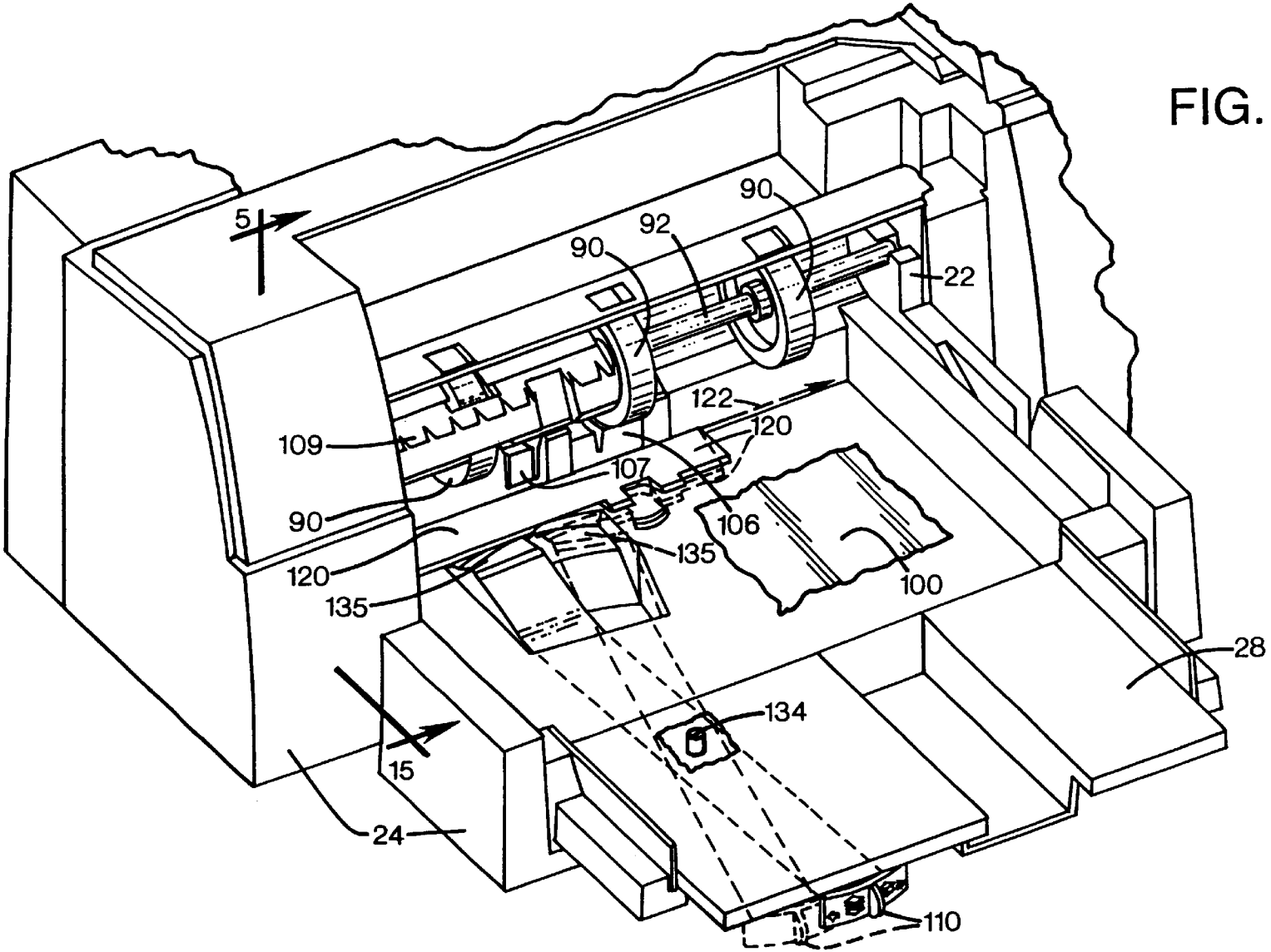
FIG. 14 is a fragmented perspective view of the inkjet printer of FIG. 1, with several components removed to show the operation of the media select lever.
Figure 15:
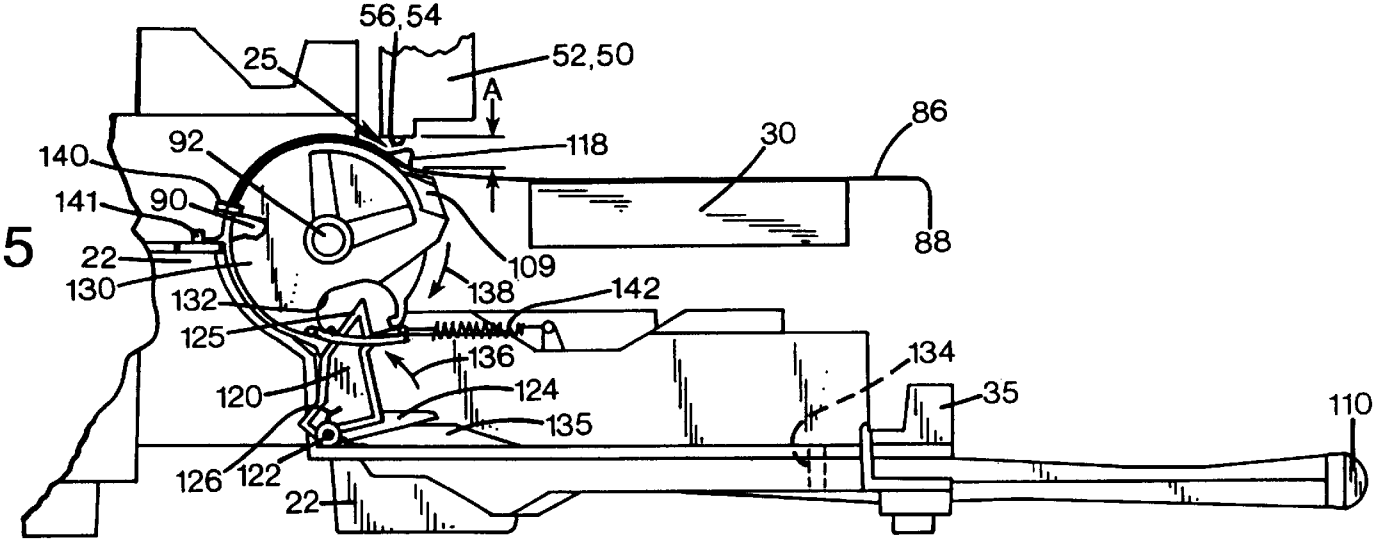
FIGS. 15 and 16 are fragmented, sectional, side elevational views taken along lines 15—15 of FIG. 14, with FIG. 15 showing the printhead-to-media spacing adjusted for Z-fold media, and FIG. 16 showing the printhead-to-media spacing adjusted for cut-sheet media.
Figure 16:
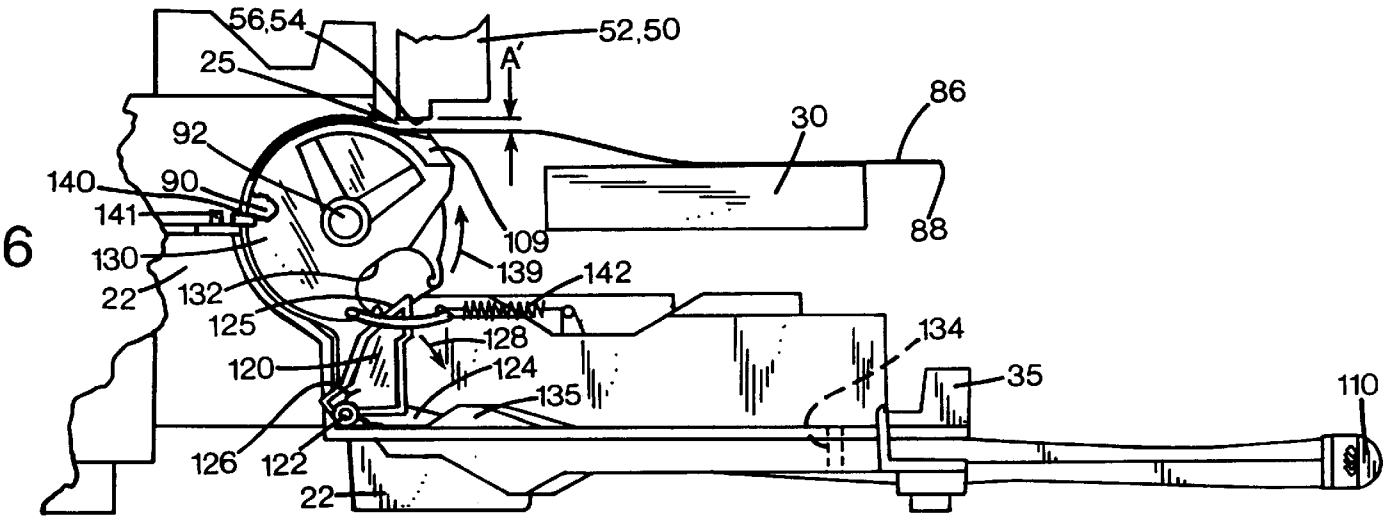

Turning now to FIGS. 14–17, as mentioned briefly above, the media selector lever 110 may be used to adjust the printhead-to-media spacing, a spacing which is known in the art as "pen-to-paper spacing," since the most common media used is paper. Preferably, the pen-to-paper spacing or "PPS" is increased when printing with Z-fold media to dimension A as shown in FIG. 15, over the PPS used for printing cut-sheet media, shown as dimension A' in FIG. 16 (A'<A). This increased PPS prevents the upwardly projecting folded perforations or "tents" 118 (FIG. 15) in the Z-fold media 85, as well as any bulges beside downwardly projecting valleys in the folded perforations, from hitting the printheads 54, 56 during printing. Any such contact of the printheads 54, 56 with the media 85 could lead to a smeared image, or worse yet, printhead damage for instance, from media fibers being rammed into the printhead nozzles. A preferred manner of accomplishing this PPS adjustment using lever 110 is shown in FIGS. 14–16.

In FIG. 14, the banner selection lever 110 is shown in solid lines moved to the right in the Z-fold media position to lower the pivot 109 and increase the PPS dimension A to accommodate the Z-fold tents 118. The cut-sheet position of the banner lever 110 is shown in dashed lines in FIG. 14. The illustrated media handling system 26 includes a lifter shaft assembly 120 which is pivoted to the chassis 22 along a pivot axis 122. The lifter shaft assembly 120 has a lower foot portion 124 and an upper leg portion 125 which are biased by a torsional coil spring 126 to pivot in a clockwise direction 128 around axis 122 toward a cut-sheet or rest position shown in FIG. 16. A clutch mechanism, such as a clutch disk member 130 is mounted for limited rotation around the drive roller shaft 92 to raise and lower the pivot 109 with respect to the printheads 54, 56. That is, counterclockwise rotation (arrow 139) of the clutch disk 130 rotates the lifter shaft lower foot 124 upwardly in a counterclockwise direction, causing the distal end of foot 124 to push against the under surface of the pressure plate 100 to raise the pressure plate to the media pick and feed positions shown in FIGS. 6–13. As described further below with respect to FIGS. 17–19, the clutch disk 130 is selectively coupled to the drive motor 93 through operation of the printhead carriage 40, so the clutch disk may be driven by the motor 93. The clutch disk 130 defines a clutch pocket 132 which has an edge that is selectively engaged by an upper surface of the leg portion 125 of the lifter shaft assembly 120.

The banner lever 110 is pivoted near a mid-span point to the chassis 22 at a pivot post 134. The banner lever 110 has a wedge-shaped head 135 at the distal end of the lever which engages an undersurface of the lifter shaft assembly foot 124. As shown in FIGS. 14 and 15, when an operator moves the banner select lever 110 to the right (Z-fold position), the wedge shaped head 135 moves toward the left and under the lifter shaft foot 124 to elevate foot 124. Elevating foot 124 pivots the assembly 120 in a counterclockwise direction 136 around axis 122, so the upper surface of the lifter shaft leg 125 pushes on the edge of the clutch pocket 132, which rotates the clutch disk member 130 in a clockwise direction 138. This clockwise rotation 138 of the clutch disk 130 drops the pivot 109 away from the printheads 54, 56 to lower the media and increase the PPS to dimension A. The additional clearance provided by the larger PPS dimension A for Z-fold prevents printhead crashes with the Z-fold tents 118 or with any bulges adjacent downwardly projecting Z-fold valleys, which are simply folds in a direction opposite to those of the tents 118.

When the operator decides to return to printing on cut-sheet media, the banner select lever 110 is moved to the left, which moves the wedge-shaped lever head 135 to the right, as indicated in dashed lines in FIG. 14. In this cut-sheet position, the lever head 135 resides in a recess underneath the lifter shaft foot 124. Moving the selector lever 110 to the cut sheet position allows the lifter shaft assembly 120 to rotate in the clockwise direction 128 (FIG. 16) under the force of the torsional coil spring 126 to the cut-sheet position, where a clutch disk stop 140 comes to rest against a conventional cut-sheet spacing adjuster 141. Preferably, the cut-sheet spacing adjuster 141 is adjustable with respect to the chassis 22 to set the cut-sheet PPS dimension A' to a desired level during factory assembly of printer 20. This downward rotation 128 of the lifter shaft assembly 120 allows the edge of the clutch pocket 132 to ride along the upper surface of the lifter shaft leg 125, which rotates the clutch disk 130 in a counterclockwise direction 139 under the force of a return spring 142. The return spring 142, shown schematically in FIGS. 15 and 16, couples the clutch disk 130 and pivot 109 to the chassis 12 to rotate the pivot 109 upwardly to close the PPS dimension A back to a cut-sheet spacing, indicated as dimension A' (FIGS. 16 and 18).

To provide feedback to the controller 36 as to what position the media select lever is currently adjusted, a variety of different mechanisms may be used, such as limit switches, and optical or electromagnetic sensors. However, these devices increase the overall number of parts used to make the printer 20, as well as increasing the assembly cost. Additionally, these devices increase the complexity of the controller 36, which also adds to the cost of the printer 20.

Figure 17:
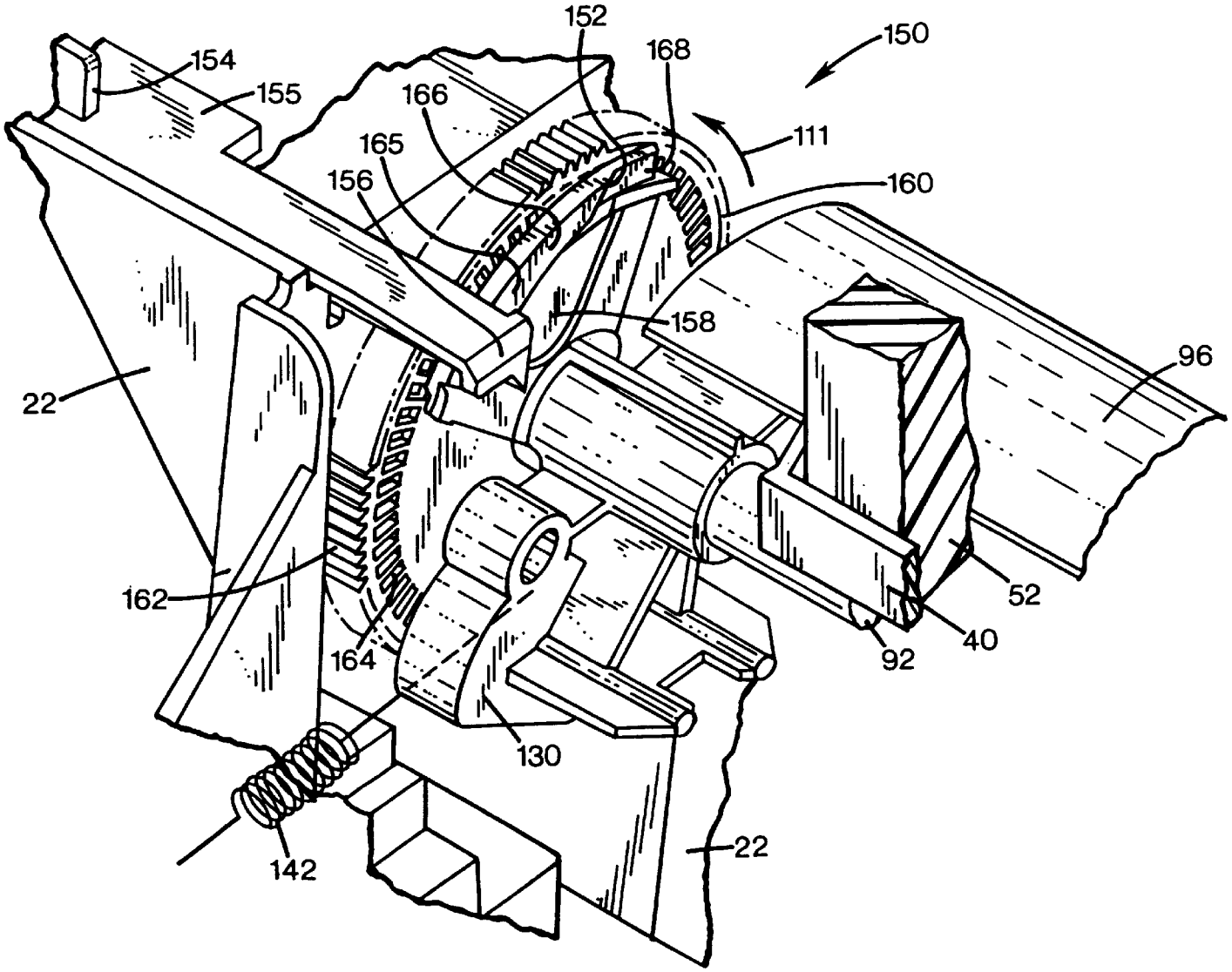
FIGS. 17–19 are perspective views of a feedback portion of the Z-fold media handling system of FIG. 1, showing various stages of operation as follows.
Figure 18:
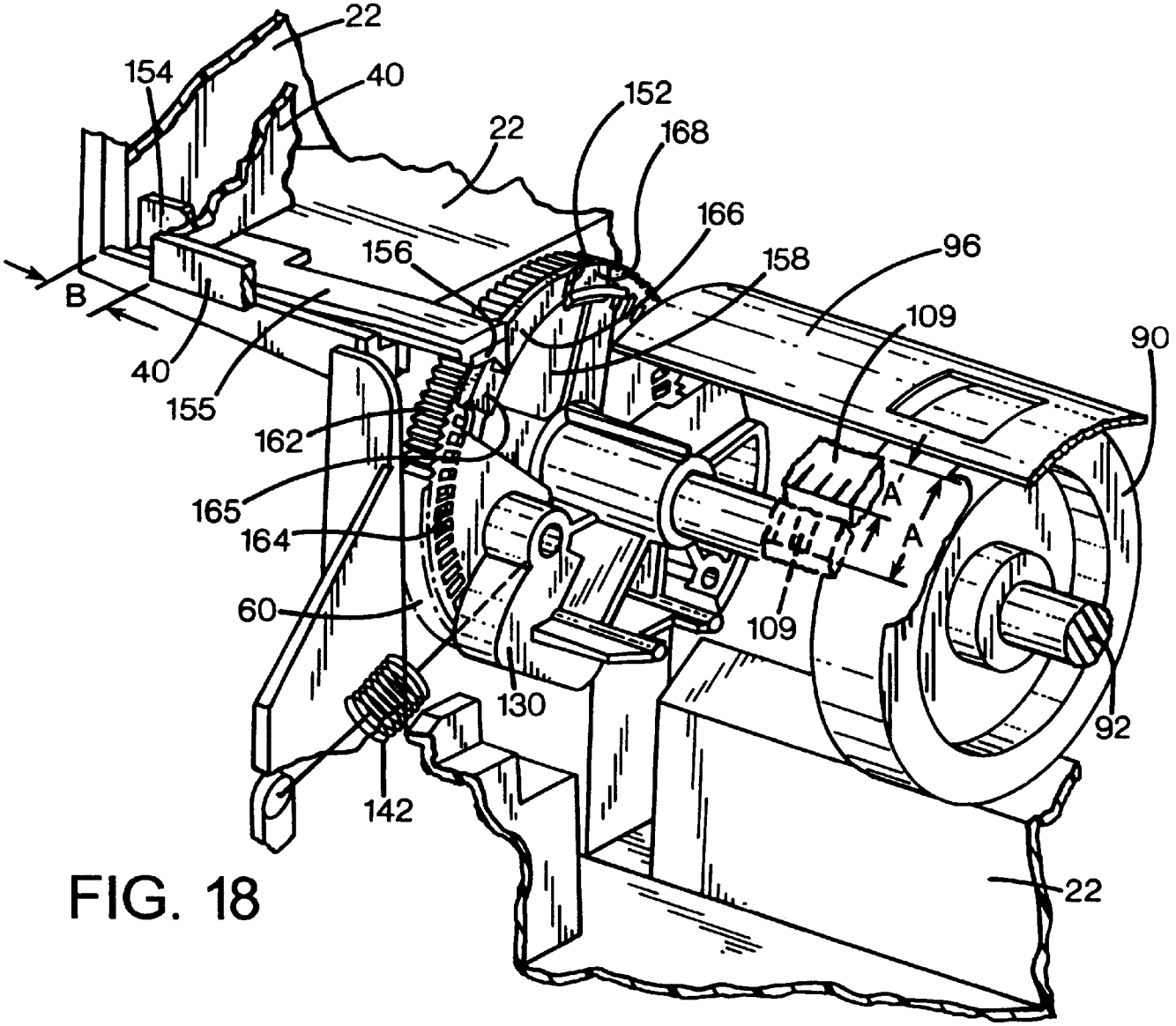
Figure 19:
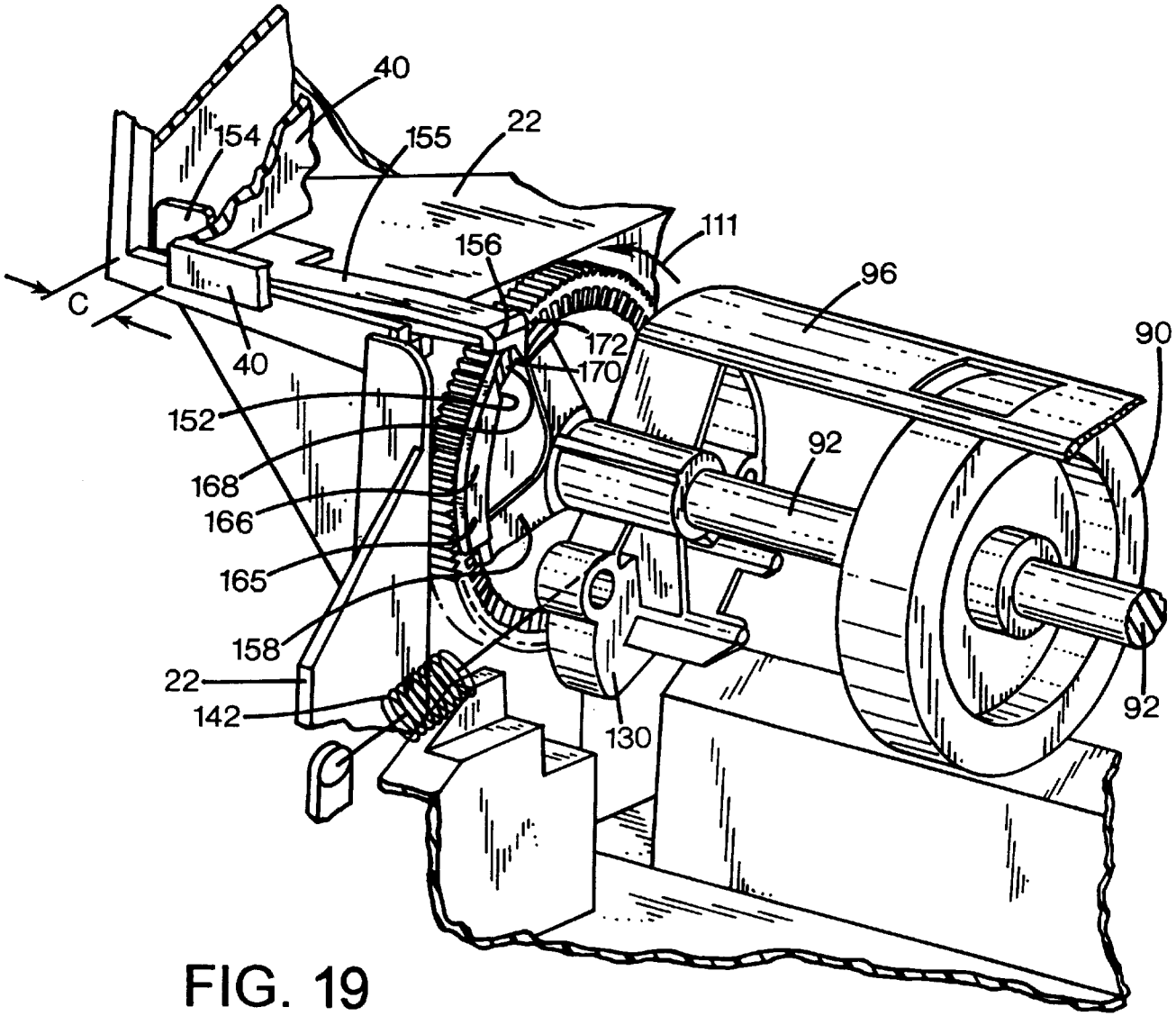

FIGS. 17–19 show a banner lever position detection system 150 in accordance with the present invention for determining the position of the banner lever 110, with the lifter shaft assembly 120 omitted for clarity in these views. This lever detection scheme 150 uses the optical positional feedback system already installed on the printhead carriage 40. This banner lever position detection system 150 places a physical bump or ridge 152 on the clutch disk 130. As mentioned briefly above, the printhead carriage 40 is used to alter positions of the pivot 109 and pressure plate 100 between a media pick position (in the first step 64, and in FIGS. 6–11), and a cut-sheet feed position (FIG. 16) or a Z-fold banner feed position (the eighth and ninth steps 78, 80, and in FIGS. 12, 13 and 15). FIGS. 17–19 show how this is accomplished.

At the beginning of the first step 64, the printhead carriage 40 moves to the far left (as shown in FIGS. 1 and 17–19) and hits a shoulder portion 154 of a clutch actuator mechanism, such as an actuator or arm 155. The actuator arm 155 also has a head portion 156, opposite the shoulder 154. When the carriage 40 pushes the actuator 155 to the far left (FIGS. 18 and 19), the head 156 pulls a flexible wall portion 158 of clutch 130 into contact with a portion of a bull gear 160 of the stepper motor and gear assembly 93 (see FIG. 1). The bull gear 160 periphery has media drive teeth 162 formed thereon which are coupled to the stepper motor to pick and feed media. The bull gear 160 also has a face adjacent the clutch 130 with a series of clutch drive teeth 164 formed thereon. The clutch flexible wall 158 of clutch 130 has an outboard surface with teeth (not shown) formed thereon to engage the clutch drive teeth 164 of the bull gear 160 when the carriage 40 moves the actuator 155 to an initial engaged position at the far left of the printer 20, as shown in FIG. 18.

Opposite the geared surface of the flexible wall 158, an inboard surface of wall 158 has a cammed surface or cam 165 formed thereon. The cam 165 has a contour comprising first and second cam portions, here, shown as thick and thin portions 166 and 168, respectively of wall 158. The first and second cam portions are separated by a clutch cam feature, such as a clutch bump or ridge, here illustrated as shoulder 152 which joins together the thick and thin portions 166 and 168. An under surface of the actuator head 156 advantageously serves as a cam follower that rides along a cam surface 165.

During the media pick routine 84, the controller 36 monitors the position of the printhead carriage 40 using the encoder strip 47 (FIG. 1), which provides an indication of when the carriage 40 moves. Of particular interest is when the actuator head 156 slides down the clutch bump shoulder 152 on the clutch disk 130. How long, i.e., how many steps of the media drive stepper motor 93 are required to reach the clutch bump shoulder 152, indicates the initial position of the pivot. 109. By counting the number of motor steps, from the initial position of the pivot 109, which is adjusted by the operator's positioning of the media select lever 110, the controller 36 may determine whether the pivot 109 is in the Z-fold printing position (FIG. 15, PPS dimension A) or in the cut-sheet printing position (FIG. 16, PPS dimension A'). If reading this for the first time, it takes a few moments to figure out this unique inventive concept, as several components are now acting together. While carriage-activated media drive clutch mechanisms have been used in the past, for example as described in U.S. Pat. No. 5,000,594, assigned to the present assignee, Hewlett-Packard Company, this is the first time the inventors are aware of that such a mechanism has been used to provide media-to-printhead spacing information to the controller 36.

To initiate a media pick (for either Z-fold or cut-sheet media), the carriage 40 pushes on the clutch actuator 155 to engage the flexible wall 158 of clutch 130 with the drive roller bull gear 160. While the carriage 40 is still pushing on the clutch actuator 155 to keep the gears on the flexible clutch wall 158 engaged with the bull gear face gears 164, the controller 36 starts the media drive motor 93 turning to move the media drive rollers 90. The controller then keeps track of the number of motor steps during the first step 64 of method 84, looking for two points, (1) when the pressure plate 100 raises to pick position, and (2) when the actuator 155 encounters the cam feature or clutch bump 152. For the illustrated printer 20, after about 340 steps of this stage of operation, the actuator arm 155 has a locking face 170 which falls into a lock position adjacent a latch surface 172 of the clutch disk flexible wall 158 (FIG. 19), which through the operation of the lifter shaft assembly 120 (see FIGS. 15–16) also raises the pressure plate 100 to the media pick position.

During the first portion of this stage of the media pick operation (for both Z-fold and cut-sheet media), from the first step of drive motor 93 up to about step 240, the controller 36 monitors the position of the carriage 40 through the encoder 47, while counting the number of media advance steps taken by motor 93. As the actuator head 156 slides along the clutch disk cam surface 165, it finally slides down the clutch bump shoulder 152, causing the carriage 40 to move further to the left, with this change in carriage position being detected by the controller 36 using the encoder strip 47 and the conventional encoder reader mounted on the carriage 40. For example, the parameter monitored by the controller 36 may be the number of steps that the media drive motor 93 makes from the start position until the change in the position of the printhead carriage 40 as it slides over the clutch bump feature 152. It is apparent that other parameters may be used to detect this change in carriage position, such as time of rotation, rate of change of carriage location or motor rotation, threshold levels for distances, degrees of rotation, etc., any of which reflects this difference in the angular position of the pivot 109 by monitoring the rotation of the drive motor 93 from a starting position to an ending position defined by the contour of clutch disk cam surface.

The two cases to be distinguished are positions of the pivot 109 for Z-fold media (FIG. 15) and for cut-sheet media (FIG. 16). In FIG. 15, the pivot 109 is rotated downwardly (PPS=dimension A) for Z-fold media prior to the initiation of a pick cycle because the operator has moved the media selector lever 110 to the right, which corresponds to the Z-fold banner position. This downward position of the pivot 109, which is coupled to the clutch 130 by the carriage 40, begins at a position indicated in FIG. 15 and in dashed lines in FIG. 18, which is lower than the pivot (and clutch) starting positions for cut-sheet media, as indicated in FIG. 16 and in solid lines in FIG. 18. During the pick cycle, the number of media drive motor steps it takes to detect the change in carriage position caused by traveling over the clutch bump 152 will be fewer for Z-fold media than when the media selector lever 110 is moved to the left for cut-sheet media and the pivot 109 is raised to the cut-sheet position of FIG. 16.

The number of steps of the drive motor 93 are correlated to correspond to the distance of travel, and provide an indication to the controller 36 of the position of the media select lever 110. For example, about 180 motor steps indicate a cut-sheet position, whereas about 100 motor steps indicate that the lever 110 is in the banner position. The controller 36 may use this information to supply a message to the host computer, which may respond by instructing the operator to move the lever 110 to a desired position corresponding to the type of media selected in the printer set-up program.

Thus, a variety of advantages are realized using the Z-fold media handling system 26 and routine 84 described herein. One of the most significant advantages is the ability to easily print on Z-fold media using the same inkjet printer one uses to print on conventional cut-sheet media. Furthermore, the mechanism employed is quiet and does not need a bulky tractor drive mechanism to feed the Z-fold media. As a further advantage, while the media stack 85 has been shown with the free end of the uppermost sheet loaded in the input tray against wall 104, the system 26 also functions as described above if the free end of this uppermost sheet is located adjacent the length adjuster 35. When loaded with free end of the uppermost sheet against the length adjuster 35, this uppermost sheet is pulled through the feed path 95 underneath the next sheet down in the stack, that is, the uppermost sheet travels between the drive rollers 90 and this next sheet down. In this case, no printing occurs on this uppermost sheet because when in the printzone 25, the sheet that was uppermost in the stack 85 is then underneath what was the next sheet in the stack. Here, the edges where the uppermost sheet joins the next down sheet serves as the leading edge 88. Thus, this next sheet down serves as the first sheet 86 to receive ink, whereas the uppermost sheet serves as a blank leader sheet, which is typically detached from the printed banner then discarded or recycled.

Additionally, this system 26 and routine 84 are accomplished without significantly impacting the cost of the printer mechanism 20, for example by using the carriage encoder strip 47 along with a slight modification to the clutch disk 130, to monitor the media select lever's position. Placement of the media select lever 110 near the media input tray 28 enhances the ease of switching between types of media, since the icons on the lever 110 provide a quick reminder to the user that the lever needs to be adjusted. Furthermore, providing the lever 10 in a color which contrasts with the color of the balance of the printer enclosure 24 draws user attention to the lever as a component which needs to be adjusted prior to printing.

We claim:

1. A mechanism for printing on either cut-sheet media or on Z-fold media having a leading edge followed by subsequent sheets in a Z-folded arrangement, comprising:

a media supply which holds either the cut-sheet media or the Z-fold media;

a printhead which prints on either cut sheet media or Z-fold media when in a printzone;

a drive assembly which delivers either cut-sheet media or the leading edge of the Z-fold media followed by said subsequent sheets from the media supply to the printzone in response to a control signal through incremental frictional engagement with the leading edge of the Z-fold media or through constant frictional engagement with the cut sheet media; and a controller which generates the control signal comprising either a cut-sheet signal for cut-sheet media or a Z-fold signal for Z-fold media.

2. A printing mechanism according to claim 1 further including:

a media selector activatable to select cut-sheet media or to select Z-fold media; and a media support member, responsive to the media selector, that supports media when in the printzone.

3. A printing mechanism according to claim 2 further including a media selection monitoring mechanism, and wherein the controller includes a monitoring portion responsive to the media selection monitoring mechanism to determine a media selection comprising either a cut-sheet selection when the media selector has been activated to select cut-sheet media, or a Z-fold selection when the media selector has been activated to select Z-fold media.

4. A printing mechanism according to claim 2 wherein:

the media drive assembly includes a drive motor that operates in response to a motor control signal;

the media support member and the printhead define a printhead to media spacing comprising a distance between the printhead and media when in the printzone, with the media support member being driven by the drive motor from a print position to a pick position, with the drive motor rotating a first distance to a print position comprising a cut-sheet printhead to media spacing when the media selector has been activated to select cut-sheet media, and with the drive motor rotating a second distance to a print position comprising a Z-fold printhead to media spacing when the media selector has been activated to select Z-fold media; and the controller generates the motor control signal and determines from the first rotation that the media selector has been activated to select cut-sheet media, and from the second rotation that the media selector has been activated to select Z-fold media.

5. A printing mechanism according to claim 2 wherein:

the media support member and the printhead define a printhead to media spacing comprising a distance between the printhead and media when in the printzone; and the media support member responds to the media selector to adjust the printhead to media spacing to a Z-fold spacing when the media selector is activated to select Z-fold media.

6. A printing mechanism according to claim 5 wherein the media selector comprises a lever mechanism positionable by an operator to a cut-sheet position to select cut-sheet media and to a Z-fold position to select Z-fold media.

7. A printing mechanism according to claim 5 wherein the Z-fold spacing is greater than the cut-sheet spacing.

8. A mechanism for printing according to claim 1 wherein the printhead comprises an inkjet printhead with nozzles for selectively ejecting drops of ink onto either Z-fold media or cut-sheet media.

9. A method of printing in a printing mechanism having a printzone from a supply holding Z-fold media having a leading edge followed by subsequent sheets in an Z-folded arrangement, comprising the steps of:

incrementally advancing the leading edge of the Z-fold media from the supply toward the printzone in a series of steps through frictional engagement therewith, with each of the steps of the series being separated in time by a pause;

separating the leading edge from a next one of said subsequent sheets during said advancing step; and thereafter, moving the Z-fold media into the printzone for printing.

10. A method according to claim 9, wherein the incrementally advancing step comprises advancing the leading edge of the Z-fold media from the supply toward the printzone in a series of forward steps, which are separated by a backwards step in a direction opposite said forward steps, with the backwards steps being of smaller magnitude than the forward steps.

11. A method according to claim 9, further including the steps of: following printing on the Z-fold media, loading cut-sheet media in the supply; and advancing the cut-sheet media from the supply to the printzone for printing.

12. A method according to claim 9, further including the steps of:

before the incrementally advancing step, locating the position of the leading edge by advancing the leading edge toward the printzone; and after the locating step and before the incrementally advancing step, moving the leading edge away from the printzone.

13. A method according to claim 12 wherein:

the locating step comprises the step of bending the leading edge around a roller member; and the method further includes the step of, during said bending step, also bending the next one of said subsequent sheets around the roller member to separate the leading edge therefrom.

14. A method according to claim 9, further including the steps of:

before the incrementally advancing step, moving the leading edge toward the printzone at a first speed; and thereafter, moving the leading edge and the next one of said subsequent sheets away from the printzone at a second speed.

15. A method according to claim 9, further including the steps of:

after the incrementally advancing step, moving the leading edge and the next one of said subsequent sheets away from the printzone at a first speed; and thereafter, moving the leading edge toward the printzone at a second speed which is slower than the first speed.

16. A printing mechanism for printing on Z-fold media having a leading edge followed by subsequent sheets in an Z-folded arrangement, comprising:

a frame defining a printzone;

a printhead which, in response to a printing signal, prints a selected image on media when in the printzone;

a supply which holds the Z-fold media;

a drive assembly which, in response to a control signal, incrementally advances the leading edge of the Z-fold media from the supply toward the printzone in a series of steps through frictional engagement therewith, with the drive assembly pausing between each of said steps to separate the leading edge from said subsequent sheets; and a controller which generates the control signal and the printing signal.

17. A printing mechanism according to claim 16 for also printing on cut-sheet media wherein:

the supply also holds cut-sheet media;

the drive assembly delivers a sheet of the cut-sheet media from the supply to the printzone; and the controller generates the control signal which comprises either a cut-sheet signal for cut-sheet media or a Z-fold signal for Z-fold media.

18. A printing mechanism according to claim 17 further including:

a media selector activatable to select cut-sheet media or to select Z-fold media; and a media support member, responsive to the media selector, that supports media when in the printzone.

19. A printing mechanism according to claim 18 further including a media selection monitoring mechanism, and wherein the controller includes a monitoring portion responsive to the media selection monitoring mechanism to determine a media selection comprising either a cut-sheet selection when the media selector has been activated to select cut-sheet media, or a Z-fold selection when the media selector has been activated to select Z-fold media.

20. A printing mechanism according to claim 18 wherein:

the media support member and the printhead define a printhead to media spacing comprising a distance between the printhead and media when in the printzone; and the media support member responds to the media selector to adjust the printhead to media spacing to a Z-fold spacing when the media selector is activated to select Z-fold media.

21. A printing mechanism according to claim 20 wherein the Z-fold spacing is greater than the cut-sheet spacing.

22. An apparatus for handling either cut-sheet media or Z-fold media having a lead edge followed by subsequent sheets in a Z-folded arrangement, comprising:

a media supply which holds either the cut-sheet media or the Z-fold media;

a drive assembly which delivers either cut-sheet media or the leading edge of the Z-fold media followed by said subsequent sheets from the media supply to a desired zone in response to a control signal through incremental frictional engagement with the leading edge of the Z-fold media or through constant frictional engagement with the cut-sheet media; and a controller which generates the control signal comprising either a cut-sheet signal for cut-sheet media or a Z-fold signal for Z-fold media.

* * * * *